US011561491B2

(12) United States Patent
Tanaka et al.

(10) Patent No.: US 11,561,491 B2
(45) Date of Patent: Jan. 24, 2023

(54) HEATING DEVICE THAT FIXES IMAGE ON RECORDING MATERIAL AND IMAGE FORMING DEVICE HAVING THE HEATING DEVICE

(71) Applicant: CANON KABUSHIKI KAISHA, Tokyo (JP)

(72) Inventors: Masashi Tanaka, Kanagawa (JP); Hikaru Osada, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/391,353

(22) Filed: Aug. 2, 2021

(65) Prior Publication Data

US 2022/0043375 A1 Feb. 10, 2022

(30) Foreign Application Priority Data

Aug. 5, 2020 (JP) ..... JP2020-132940

(51) Int. Cl.
*G03G 15/20* (2006.01)

(52) U.S. Cl.
CPC ..... *G03G 15/2017* (2013.01); *G03G 15/2053* (2013.01); *G03G 2215/2035* (2013.01)

(58) Field of Classification Search
CPC ..... G03G 15/2017; G03G 15/2053; G03G 2215/2035
USPC ..... 399/329; 219/216
See application file for complete search history.

(56) References Cited

U.S. PATENT DOCUMENTS 10,274,878 B2 4/2019 Suzuki
2002/0141796 A1* 10/2002 Nishitani ..... G03G 15/2064 399/328
2005/0123329 A1* 6/2005 Uchida ..... G03G 15/2053 399/328
2013/0236202 A1* 9/2013 Akiya ..... G03G 15/2017 399/69
2013/0336672 A1* 12/2013 Mizuta ..... G03G 15/80 439/700

(Continued)

FOREIGN PATENT DOCUMENTS

JP H0444075 A 2/1992
JP H07261594 A 10/1995

(Continued)

*Primary Examiner* — Robert B Beatty
(74) *Attorney, Agent, or Firm* — Rossi, Kimms & McDowell LLP

(57) ABSTRACT

A heating device comprising: a first rotating member having an internal space in which a heating member and a holding member are disposed; a second rotating member that contacts an outer peripheral surface of the first rotating member; and a frame that integrally supports the heating member, the holding member, the first rotating member and the second rotating member, wherein the second rotating member forms a nip portion between the first rotating member and the second rotating member, the holding member holds the heating member such that at least a part of at least one end face of the heating member in a longitudinal direction thereof is exposed in the longitudinal direction, and the frame is configured such that at least the part of the heating member, which is exposed from the holding member, is also exposed out of the frame.

22 Claims, 19 Drawing Sheets

(56) References Cited

U.S. PATENT DOCUMENTS

| | | | | |
|---|---|---|---|---|
| 2015/0338795 | A1* | 11/2015 | Yamaguchi | G03G 15/206<br>219/216 |
| 2016/0216659 | A1* | 7/2016 | Ikegami | G03G 15/2053 |
| 2019/0286028 | A1* | 9/2019 | Furuichi | G03G 15/2053 |
| 2020/0209791 | A1* | 7/2020 | Seki | G03G 15/2042 |
| 2020/0241457 | A1* | 7/2020 | Eiki | G03G 15/2064 |

FOREIGN PATENT DOCUMENTS

| | | | |
|---|---|---|---|
| JP | 2009224210 | A | 10/2009 |
| JP | 2016126323 | A | 7/2016 |
| JP | 2018036490 | A | 3/2018 |

* cited by examiner

HEATING DEVICE THAT FIXES IMAGE ON RECORDING MATERIAL AND IMAGE FORMING DEVICE HAVING THE HEATING DEVICE

BACKGROUND OF THE INVENTION

Field of the Invention

The present invention relates to a heating device and an image forming device.

Description of the Related Art

As a heating device for toner that is used for an electrophotographic system, a thermal roller type heating device, a film heating type heating device, and the like are known.

In Japanese Patent Application Publication No. H04-044075, a film heating type heating device includes: a heater which has a resistance heating element on a ceramic substrate; a fixing film which is heated by the heater and rotates; and a pressure roller which forms a nip portion by contacting the fixing film. Here a recording material carrying an unfixed toner image is heated while being conveyed through the nip portion. By this heating, the toner image on the recording material is fixed to the recording material.

However, the thermal capacity of the film heating type heating device is small, hence in a case of passing, for example, small-sized paper through the heating device, a temperature of a region (non-paper passing region) of a fixing member (e.g. fixing film, pressure roller), which is a region other than a region where paper passes (paper passing region) increases more quickly than the paper passing region. If the temperature in the non-paper passing region rises like this and the temperature of the fixing member exceeds the heat resistant temperature, the safety of the heating device drops. Therefore it is necessary to suppress temperature rising in the non-paper passing region by increasing the time intervals of paper passing, for example, and as a result, productivity of printing small-sized paper drops.

To solve this problem, Japanese Patent Application Publication No. 2018-36490 discloses a technique to cool the non-paper passing region by sending air to the edges of the heating device using a cooling fan. But even if the cooling fan is used, the non-paper passing region may not be sufficiently cooled and temperature thereof rises if printing on small-sized paper is repeatedly executed.

Therefore in conventional heating devices, a drop in productivity of printing small-sized paper due to temperature rising in the non-paper passing region has been a problem.

SUMMARY OF THE INVENTION

It is an object of the present invention to provide a heating device that can control a drop in productivity when small-sized paper is printed.

An aspect of the invention is: a heating device comprising: a heating member that includes a heating element; a holding member that holds the heating member; a first rotating member having an internal space in which the heating member and the holding member are disposed; a second rotating member that contacts an outer peripheral surface of the first rotating member; and a frame that integrally supports the heating member, the holding member, the first rotating member and the second rotating member, wherein the second rotating member forms a nip portion between the first rotating member and the second rotating member, the holding member holds the heating member such that at least a part of at least one end face of the heating member in a longitudinal direction thereof is exposed in the longitudinal direction, and the frame is configured such that at least the part of the heating member, which is exposed from the holding member, is also exposed out of the frame.

Further features of the present invention will become apparent from the following description of exemplary embodiments with reference to the attached drawings.

DESCRIPTION OF THE EMBODIMENTS (Problem of Heating Device) A problem that may occur when a film heating type heating device is used for an image forming device will be described in detail first. The film heating type heating device here uses a film having a small thermal capacity as a fixing member, hence time until the fixing member reaches (rises) to a predetermined temperature can be decreased compared with a thermal roller of a thermal roller type heating device. Furthermore, in the case of the film heating type heating device, of which rise time is short, there is no need to heat up the fixing member during standby, hence power consumption can be controlled to be low.

Figures 15A, 15B:
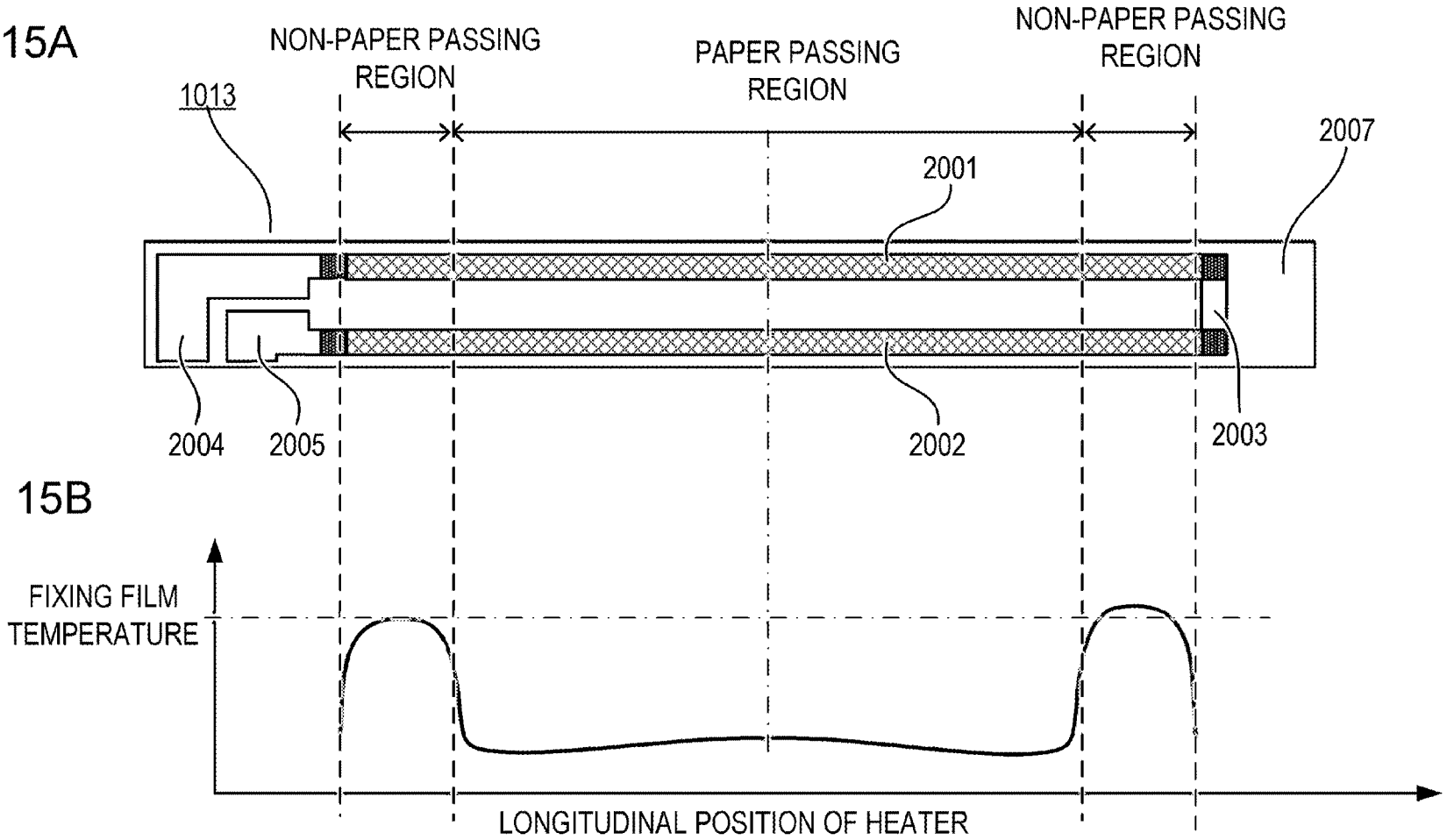
FIG. 15A and FIG. 15B are diagrams depicting a heater according to a comparative example.

FIG. 15A indicates a heater used for the heating device, and is a heater 1013 which is a comparative example of each embodiment to be described later. FIG. 15A is a cross-sectional view of the heater 1013. The heater 1013 includes resistance heating elements 2001 and 2002, which heat the fixing film by contacting the fixing film. As illustrated in FIG. 15A, in the heater 1013, the resistance heating elements 2001 and 2002 are disposed in series via a conductor 2003, on a ceramic substrate 2007. Conductive electrode units 2004 and 2005 are disposed respectively on one edge of the resistance heating element 2001 and on one edge of the resistance heating element 2002 respectively. The resistance heating elements 2001 and 2002 are heated by the electricity flowing to (energizing) the resistance heating elements 2001 and 2002 from the electrode units 2004 and 2005.

Since the heater 1013 contacts the inner surface of the fixing film of which thermal capacity is small (directly heats the fixing film), the temperature of the fixing member (fixing film, pressure roller) uniformly rises quickly in the longitudinal direction (direction perpendicular to the conveying direction of the recording material). Then if recording material (small-sized paper), of which width in the longitudinal direction of the heater 1013 is narrow, is continuously passed, the temperature in a non-paper passing region, which is a region other than a region where paper passes (paper passing region) in the fixing film, rises more than the paper passing region. This is because in the paper passing region, heat is transferred to the recording material being conveyed, but in the non-paper passing region, the recording material to which heat is transferred is not conveyed. Further, in the heater 1013 according to the comparative example, the surfaces of the heater 1013, other than the surface that contacts the fixing film, is covered by a heater holder, hence not very much heat is released to the outside.

FIG. 15B indicates the temperature distribution on the fixing film in the longitudinal direction in the case of passing small-sized paper. When such small-sized paper (recording material) is continuously passed, the temperature in the non-paper passing region of the fixing member (fixing film, pressure roller) rises, as indicated in FIG. 15B. In the following, this rise of the temperature in the non-paper passing region is referred to as "non-paper passing portion temperature rising". A possible control in the case where "non-paper passing portion temperature rising" is generated in the fixing member, is that the time interval of paper passing is increased so that the temperature in the non-paper passing region of the fixing member does not exceed the heat resistant temperature, and the temperature of the fixing member is made uniform (is equalized). Increasing the time interval of paper passing, however, drops productivity of printing small-sized paper, which is a problem.

Embodiment 1

A heating device according to Embodiment 1 will be described. The heating device according to Embodiment 1 is a film heating type heating device of which power consumption is low and which rises quickly. In the heating device according to Embodiment 1, a heater holder (holding member) covers a heater (heating member) such that an end face of the heater in the longitudinal direction (longitudinal axis direction; direction perpendicular to the conveying direction of the recording material) is exposed. Therefore the temperature in the non-paper passing region of the fixing member does not rise quickly. Thereby a drop in productivity in printing small-sized paper, where "non-paper passing portion temperature rising" tends to occur, can be controlled.

Figure 1:
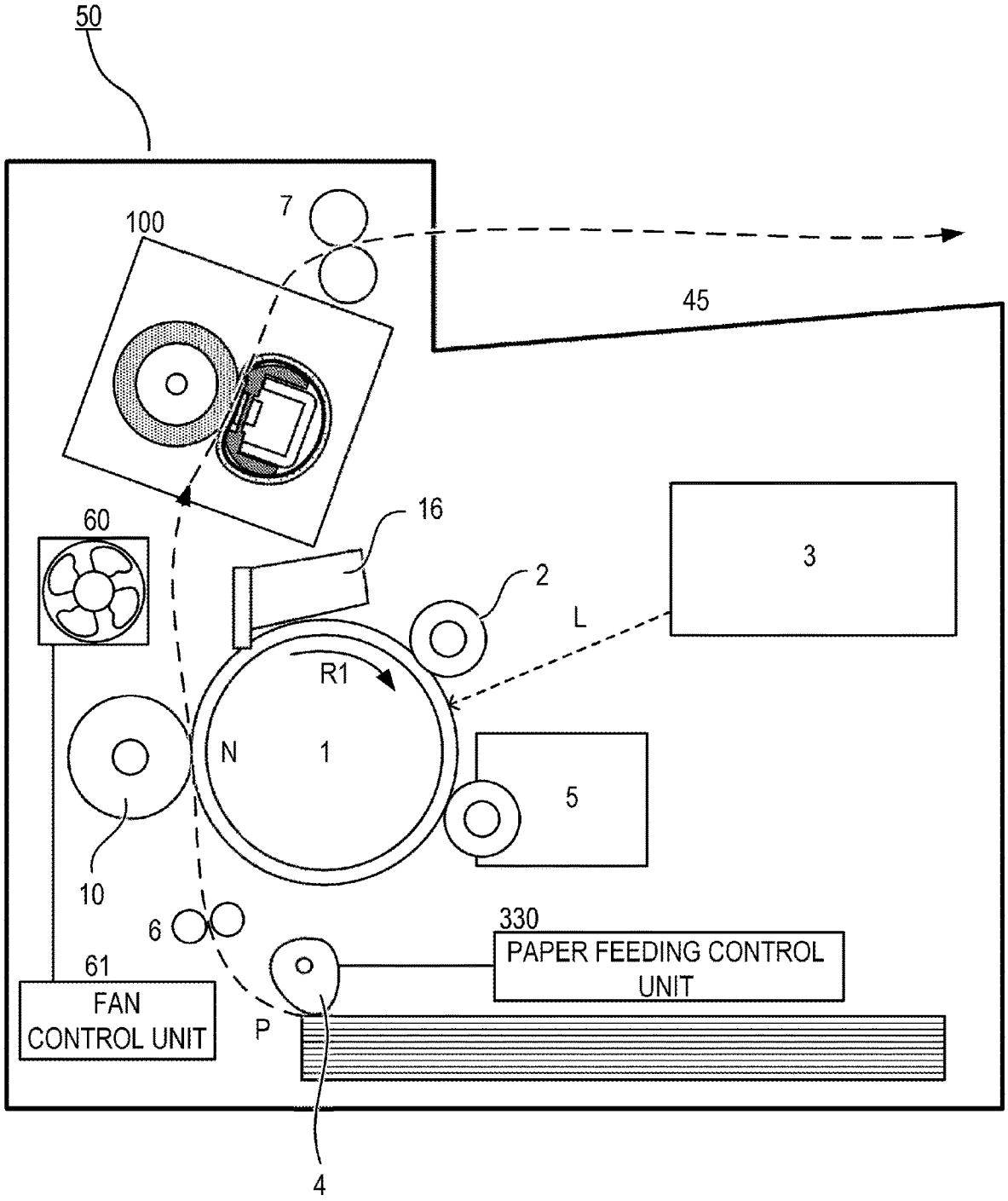
FIG. 1 is a diagram depicting an image forming device according to Embodiment 1.

<Image Forming Device> A configuration of an image forming device 50 which includes the heating device 100 according to Embodiment 1 will be described first, with reference to the schematic diagram in FIG. 1. The image forming device 50 is an electrophotographic type image forming device, which directly transfer a toner image on a photosensitive drum onto a recording material P. On a peripheral surface of a photosensitive drum 1 (image bearing member), a charging device 2, an exposure device 3 which emits laser light L to the photosensitive drum 1, a developing device 5, a transfer roller 10, and a photosensitive drum cleaner 16 are disposed sequentially along the rotation direction (arrow R1 direction).

(Print Method) A method of the image forming device 50 printing a toner image on a recording material P will be described. First a charging device 2 charges a surface of the photosensitive drum 1 (image forming unit; forming device) to a minus polarity. Then an electrostatic latent image is formed (surface potential of an exposed portion increases) on the surface of the charged photosensitive drum 1 by the laser light L of the exposure device 3. Toner of Embodiment 1 is charged to the minus polarity, and minus toner adheres only to the electrostatic latent image portion on the photosensitive drum 1 by the developing device 5 in which black toner is contained. Thereby a toner image (an image) is formed on the photosensitive drum 1.

On the other hand, prior to starting the process to form the electrostatic latent image onto the photosensitive drum 1, the recording material P is fed by a paper feeding roller 4. A paper feeding control unit 330 controls a paper feeding timing of the paper feeding roller 4 so that the front end of the recording material P reaches the transfer nip N at a timing when the front end of the toner image on the photosensitive drum 1 reaches the transfer nip N. When the paper feeding operation completes, a conveying roller 6 conveys only one recording material P to the transfer nip N. Then transfer bias having a plus polarity, which is the opposite of the polarity of the toner, is applied from a power supply (not illustrated) to the transfer roller 10. Thereby the toner image on the photosensitive drum 1 is transferred onto the recording material P in the transfer nip N. In other words, an unfixed toner image (an image) is formed on the recording material P by the photosensitive drum 1.

After the transfer, the untransferred toner is removed from the surface of the photosensitive drum 1 by the photosensitive drum cleaner 16, which includes an elastic blade. On the other hand, the recording material P bearing the toner image is transferred to the heating device 100, where the toner image is heated and fixed. In other words, the toner image (the image) formed on the recording material P is fixed to the recording material P by the heating device 100. The recording material P after the toner image is fixed is discharged onto a paper delivery tray 45 by a discharging roller 7. Thereby printing of the image on the recording material P completes.

In a case of performing printing on a plurality of recording materials P continuously, feeding of subsequent recording material is started while the toner image on the photosensitive drum 1 is being transferred to the rear end of the previous recording material. Prior to the timing when the front end of the subsequent paper reaches the transfer nip N, the process to form the electrostatic latent image on the surface of the photosensitive drum 1 is also started, and the toner image on the subsequent paper is formed on the photosensitive drum 1. When the front end of the subsequent paper reaches the transfer nip N, the toner image is transferred to the subsequent paper. The continuous printing is implemented by repeating this operation (processing).

In Embodiment 1, the surface moving speed of the photosensitive drum 1 is about 200 mm/sec, and in the case of the continuous printing, the image forming device 50 can perform 35 prints per minute of LTR-sized (letter-sized) paper. In the case of continuously printing paper of which size is smaller than LTR-sized as well, the image forming device 50 starts printing at a 35 prints/minute speed, just like the case of LTR-sized paper. Here the image forming device 50 controls to decrease the throughput by increasing the time interval of paper feeding in the middle of continuous printing, so that the temperature in the non-paper passing region of the fixing member does not exceed the heat resistance temperature.

<Cooling Fan> A cooling fan 60 (cooling device) is disposed in the image forming device 50. The cooling fan 60 drops the temperature of the photosensitive drum cleaner 16 and the photosensitive drum 1 by sending air.

For example, if the print operation is repeated, the temperature of the photosensitive drum cleaner 16 and the photosensitive drum 1 may rise and exceed the softening point of the toner due to the heat of the heating device 100. In some cases, this may solidify the waste toner inside the photosensitive drum cleaner 16, or may cause melting of the adhesion of toner in the developing device 5. In such cases, faulty cleaning of the photosensitive drum 1 and faulty development may be generated. To prevent this, if the print operation is repeated and the temperature inside the image forming device 50 rises, a fan control unit 61 operates the cooling fan 60. Then the air sent by the cooling fan 60 drops the temperature inside the image forming device 50, and the generation of faulty cleaning and faulty development can be controlled.

The cooling fan 60 can also cool the non-paper passing region of the heating device 100 (fixing member) of which temperature rises when small-sized paper is passed. In the image forming device 50, an air duct is formed so that the air of the cooling fan 60 is sent circulates around both edges of the heating device 100 in the longitudinal direction. Therefore if small-sized paper is continuously printed, the cooling fan 60 is operated by the fan control unit 61, and air of the cooling fan 60 is sent to the non-paper passing region of the fixing member, whereby the non-paper passing region is cooled.

Figure 2A:
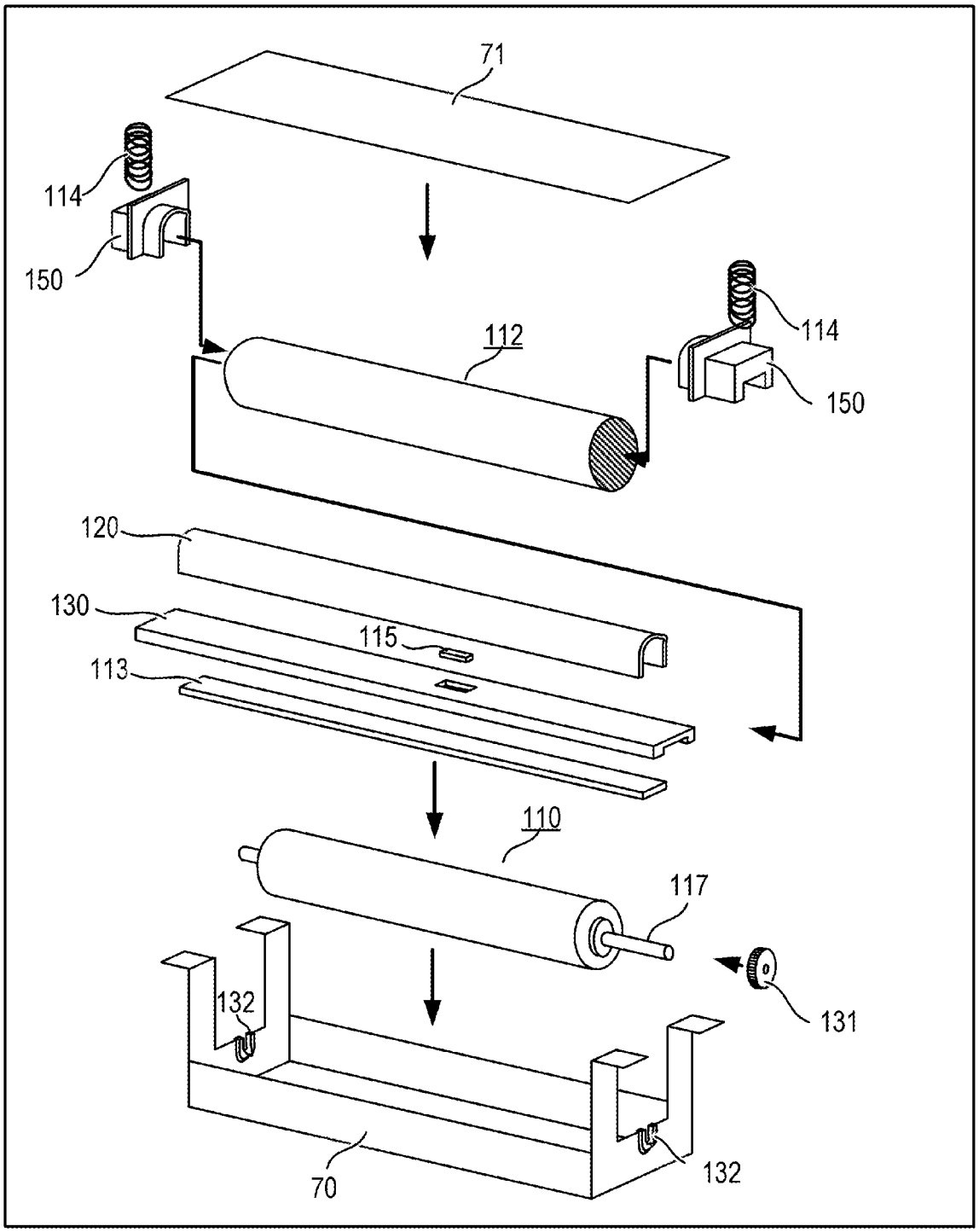
FIG. 2A and FIG. 2B are diagrams depicting a heating device according to Embodiment 1.
Figure 2B:
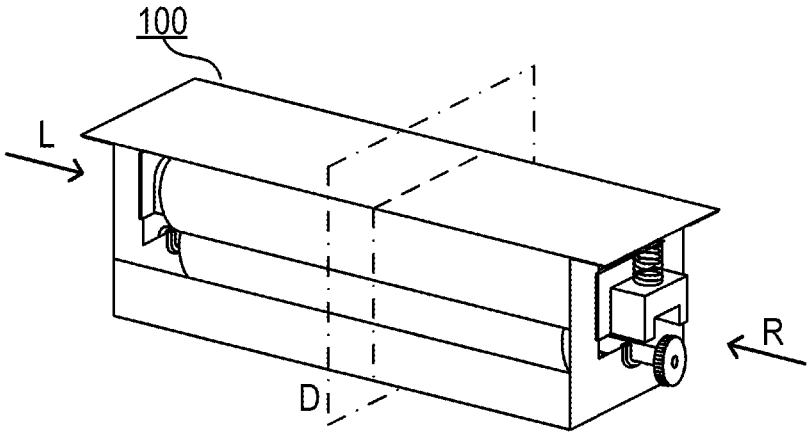

<Heating Device> The heating device 100 will be described next. The heating device 100 is a film heating type heating device that implements shortening the rise time and decreasing the power consumption. FIG. 2A and FIG. 2B are simple assembly diagrams of the heating device 100. FIG. 2A is a diagram indicating the heating device 100 in the pre-assembly state. FIG. 2B is a diagram indicating the heating device 100 in the unit state after assembly.

The configuration of the heating device 100 will be described while describing the assembly procedure of the heating device 100 with reference to the diagram on the pre-assembly state in FIG. 2A. First a core bar 117 of a pressure roller 110 is placed on bearings 132 disposed on both edges of a fixing frame 70, which is made of iron. Then a driving gear 131 is set to the core bar 117.

Then resistance heating elements of a heater 113 are installed so as to face the pressure roller 110 side, and a rear surface, which is the opposite side of the surface on which the resistance heating elements are installed, is held by a heater holder 130 made of heat resistance resin. In the heater 113, two resistance heating elements are disposed in series on a ceramic substrate, just like the comparative example (see FIG. 15A). Further, a temperature detection element 115, which detects the substrate temperature of the heater, is disposed on the rear surface of the heater 113. Here the heater holder 130 is supported by the stay 120, which is made of iron, from the opposite side of the heater 113, to reinforce holding strength.

A fixing film 112 is inserted into a member in which the heater 113, the temperature detection element 115, the heater holder 130 and the stay 120 are assembled. A fixing flange 150 is installed on each edge of the fixing film 112, so as to regulate the deviation of the fixing film in the longitudinal direction.

The fixing flange 150 on each edge is pressed by a pressure spring 114, and a film unit (unit which includes the heater, heater holder and stay in the fixing film, and has a fixing flange assembled on each edge) is pressed by the pressure roller 110. By pressing the pressure spring 114 with a fixing cover 71, the fixing cover 71 is closed to the fixing frame 70. Then the fixing frame 70 integrally supports the film unit and the pressure roller 110, whereby assembly of the unit of the heating device 100 illustrated in FIG. 2B completes.

Figure 3A:
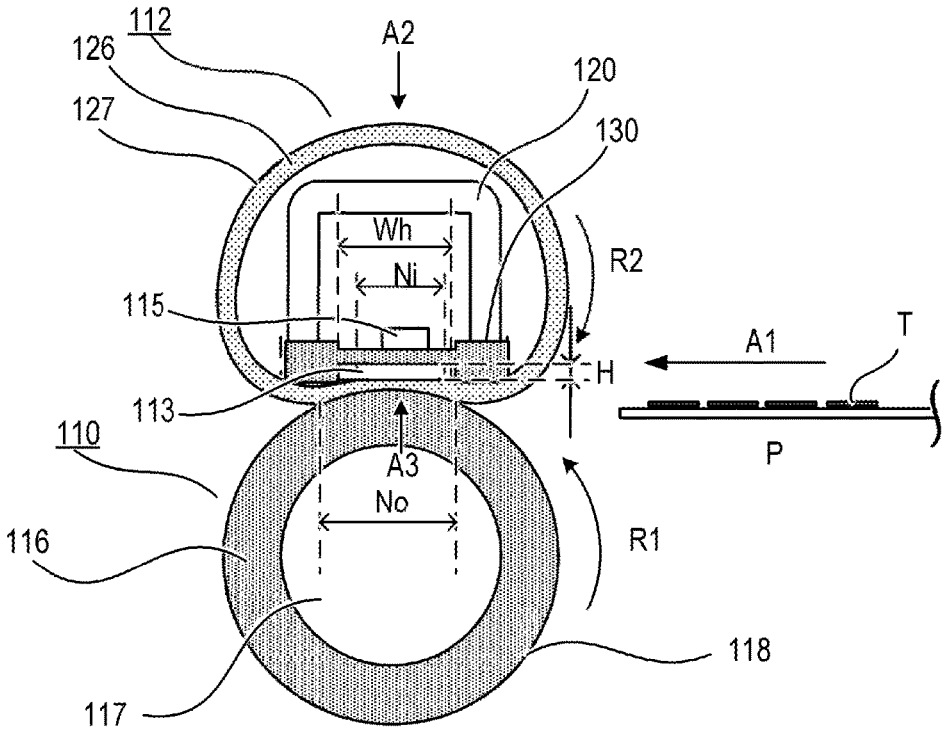
FIG. 3A and FIG. 3B are diagrams depicting the heating device according to Embodiment 1.
Figure 3B:
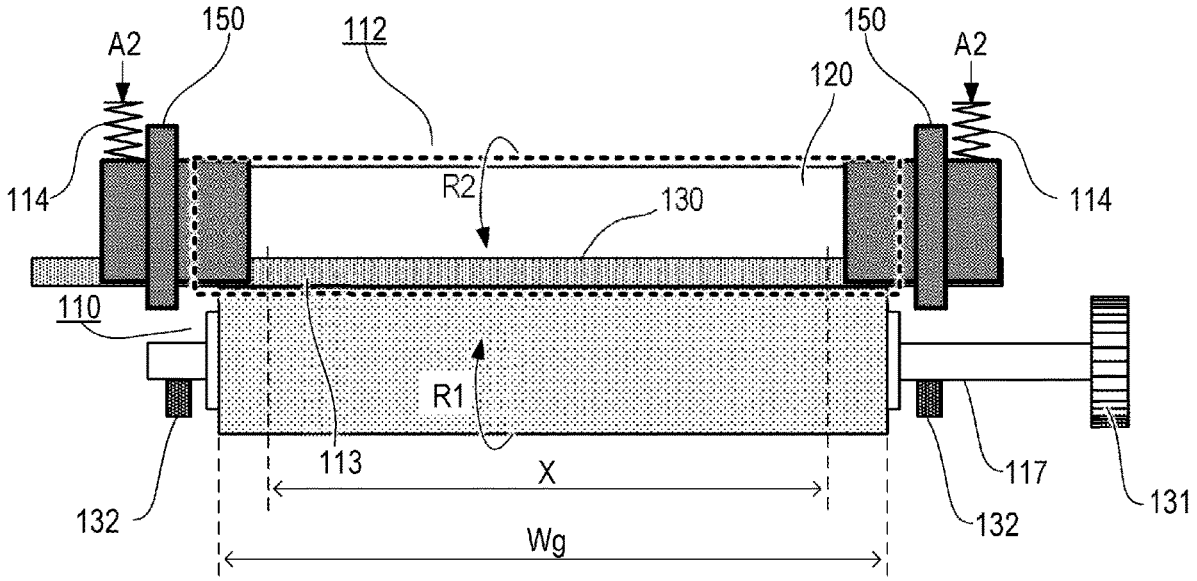

FIG. 3A is a schematic cross-sectional view of the heating device 100 in the longitudinal direction at a position of the temperature detection element 115 (dotted line D in FIG. 2B) viewed from the arrow L side in FIG. 2B. FIG. 3B is a schematic diagram viewed from the upstream side in the conveying direction of the recording material P. FIG. 3B indicates the heating device 100 where the fixing film 112 is transparent (indicated by the dotted line), in order to view the internal state more clearly.

As illustrated in FIG. 3A, the heater 113 (heating element) is held by the heater holder 130 (holding member). Further, the fixing film 112 (first rotating member), of which inner surface contacts the heater 113 and the heater holder 130 and which has a flexible tubular shape, is also disposed. In other words, the heater 113 and the heater holder 130 are disposed in an inner space of the fixing film 112. The heater 113 contacts the inner surface of the fixing film 112 to form an inner surface nip Ni, so as to heat the fixing film 112 from the inside. A heat transfer member or the like may be disposed between the heater 113 and the inner surface of the fixing film 112.

The heater 113 and the pressure roller 110 hold the fixing film 112 there between. Thereby the pressure roller 110 (second rotating member) that faces the heater 113 forms a fixing nip No so as to sandwich the fixing film 112. When a recording material P on which an unfixed toner image T is transferred is conveyed to the fixing nip No in the arrow A1 direction indicated in FIG. 3A (when the recording material P passes through the fixing nip No), the recording material P and the toner image T are heated, and the toner image T is fixed to the recording material P.

The pressure roller 110 rotates while pressing the outer surface (outer peripheral surface) of the fixing film 112. Specifically, as illustrated in FIG. 3B, the pressure roller 110 receives power from a driving source (not illustrated) to the driving gear 131 disposed on an edge of the core bar 117, and is driven (rotated) in the arrow R1 direction. When the pressure roller 110 is driven in the arrow R1 direction, the fixing film 112 receives power from the pressure roller 110 in the fixing nip No, and rotates in the arrow R2 direction.

In some cases, the fixing film 112 may be disposed in a state deviating to the left or right in the longitudinal direction. To prevent this, the fixing flange 150, to regulate the deviation, is disposed at each edge of the fixing film 112 so as to interfit with each end of the stay 120. Because of the fixing flanges 150, the inner surface of the fixing film 112 is supported at positions outside the paper passing region X.

(Fixing Film) The fixing film 112 in a tubular state (state of not being pressed by the pressure roller 110) has a φ20 mm outer diameter, and is configured to be layered in the thickness direction. The fixing film 112 includes a base layer 126 to maintain the strength of the film, and a release layer 127 to decrease the adhesion of dirt to the surface.

For the material of the base layer 126, such metal as stainless used steel (SUS) and nickel or such a heat resistant resin as polyimide may be used. This is because heat resistance is required since the base layer 126 receives heat from the heater 113, and strength is also required since the base layer comes into contact with the heater 113.

Compared with using resin as a material, metal can be more easily thinned because of its strength, and has higher thermal conductivity. Therefore if metal is used for the base layer 126, the heat of the heater 113 can be more easily transferred to the surface of the fixing film 112. On the other hand, compared with using metal as a material, resin, which has a lower specific gravity, has a smaller thermal capacity and more easily warms. Furthermore, if resin is used, thin film can be formed by coating, hence the cost of film forming can be decreased.

In Embodiment 1, polyimide resin is used as the material of the base layer 126, and carbon fillers are added to improve the thermal conductivity and strength. As the base layer 126 becomes thinner, it is easier to transfer the heat of the heater 113 to the surface of the pressure roller 110, but strength decreases. Therefore the thickness of the base layer 126 is preferably about 15 μm to 100 μm, and is 50 μm in Embodiment 1.

For the material of the release layer 127, on the other hand, fluororesin, such as perfluoroalkoxy resin (PFA), polytetrafluoroethylene resin (PTFE) and tetrafluoroethylene/hexafluoropropylene resin (FEP) can be used. In Embodiment 1, PFA, which excels among fluororesins in terms of releasability and heat resistance, is used as the material of the release layer 127. The release layer 127 may be formed by covering the base layer 126 with a tube, or the release layer 127 may be formed by coating the surface of the base layer 126 with coating material. In Embodiment 1, the release layer 127 is formed by coating the base layer 126 with a coating material which excels in thin film coating. As the release layer 127 becomes thinner, it is easier to transfer the heat of the heater 113 to the surface of the fixing film 112, but if the release layer 127 is too thin, durability drops. Therefore the thickness of the release layer 127 is preferably about 5 μm to 30 μm, and is 10 μm in Embodiment 1.

(Pressure Roller) The outer diameter of the pressure roller 110 is φ20 mm. In the pressure roller 110, as illustrated in FIG. 3A, an elastic layer 116 (foamed rubber), which is foamed silicon rubber having a 4 mm thickness, is formed on the core bar 117 which is a φ12 mm iron bar. If the thermal capacity and thermal conductivity of the pressure roller 110 are high, the heat on the surface of the pressure roller 110 is easily absorbed inside, hence the surface temperature of the pressure roller 110 does not rise quickly. On the other hand, if a material of which thermal capacity and thermal conductivity are low and heat resistance effect is high is used for the pressure roller 110, the rise time of the surface temperature of the pressure roller 110 can be shortened. The thermal conductivity of the foamed rubber generated by foaming silicon rubber is 0.11 to 0.16 W/m·K, which is lower than the thermal conductivity of the solid rubber, which is about 0.25 to 0.29 W/m·K. The specific gravity, which is related to the thermal capacity, is about 1.05 to 1.30 in the case of the solid rubber, and is about 0.45 to 0.85 in the case of the foamed rubber. In other words, the thermal capacity of the foamed rubber is lower than the solid rubber. Hence if the foamed rubber is used for the elastic layer 116, the rise time of the surface temperature of the pressure roller 110 can be shortened.

As the outer diameter of the pressure roller 110 is smaller, the thermal capacity is smaller, but if the outer diameter is too small, the width to the fixing nip No decreases. Therefore in Embodiment 1, the outer diameter of the pressure roller 110 is φ20 mm. Further, if the elastic layer 116 is too thin, the heat is transferred from the elastic layer 116 to the metal core bar 117, hence the elastic layer 116 requires an appropriate thickness. Therefore in Embodiment 1, the thickness of the elastic layer 116 is 4 mm.

When the pressure roller 110 is heated, the heat is released from the end faces of the core bar 117 and elastic layer 116, thereby the temperature of the edges of the elastic layer 116 drops. This means that if the width Wg of the elastic layer 116 in the longitudinal direction is too short, with respect to the maximum paper passing width to convey a recording material, fixability of the toner image T on the edges of the recording material P tends to drop. If the width Wg is too wide, on the other hand, the width of the image forming device 50 must be increased. Therefore in Embodiment 1, the width Wg of the elastic layer 116 in the longitudinal direction is 226 mm, that is, longer than the letter sized 216 mm (maximum width of the recording material can be conveyed) by 5 mm on the left and right respectively.

A release layer 118 made of perfluoroalkoxy resin (PFA) is formed on the outer periphery of the elastic layer 116. The release layer 118 may be a layer formed by covering the elastic layer 116 with a tube, or a layer formed by coating the surface of the elastic layer 116 with coating material, just like the case of the release layer 127 of the fixing film 112. In Embodiment 1, the release layer 118 is a layer formed by covering the surface of the elastic layer 116 with a tube having good durability. For the material of the release layer 118, a fluororesin, such as PTFE and FEP, or a fluoro rubber or silicon rubber having good releasability, may be used.

As the surface hardness of the pressure roller 110 becomes lower, the width of the fixing nip No can be increased, even if the pressure by the pressure roller 110 is low (even if the pressure is light). However, if the surface hardiness of the pressure roller 110 is too low, the durability of the pressure roller 110 decreases. Therefore in Embodiment 1, the surface hardness of the pressure roller 110 is 400 in Asker-C hardness (4.9 N load).

The pressure roller 110 is rotated by a rotating unit (not illustrated) in the arrow R1 direction indicated in FIG. 3A, at a surface moving speed of 200 mm/sec.

(Heater) For the heater 113, a heater (heating member), where resistance heating elements are disposed in series on a ceramic substrate, is used. In the heater 113, resistance heating elements made of Ag/Pd (silver palladium) are coated to 10 μm on the surface of the alumina substrate (a width: Wh=6 mm in the conveying direction of the recording material P and thickness: H=1 mm) by screen printing. Furthermore, glass covers the substrate, on which the resistance heating elements are coated, to a 50 μm thickness as the heating element protective layer.

Figure 4:
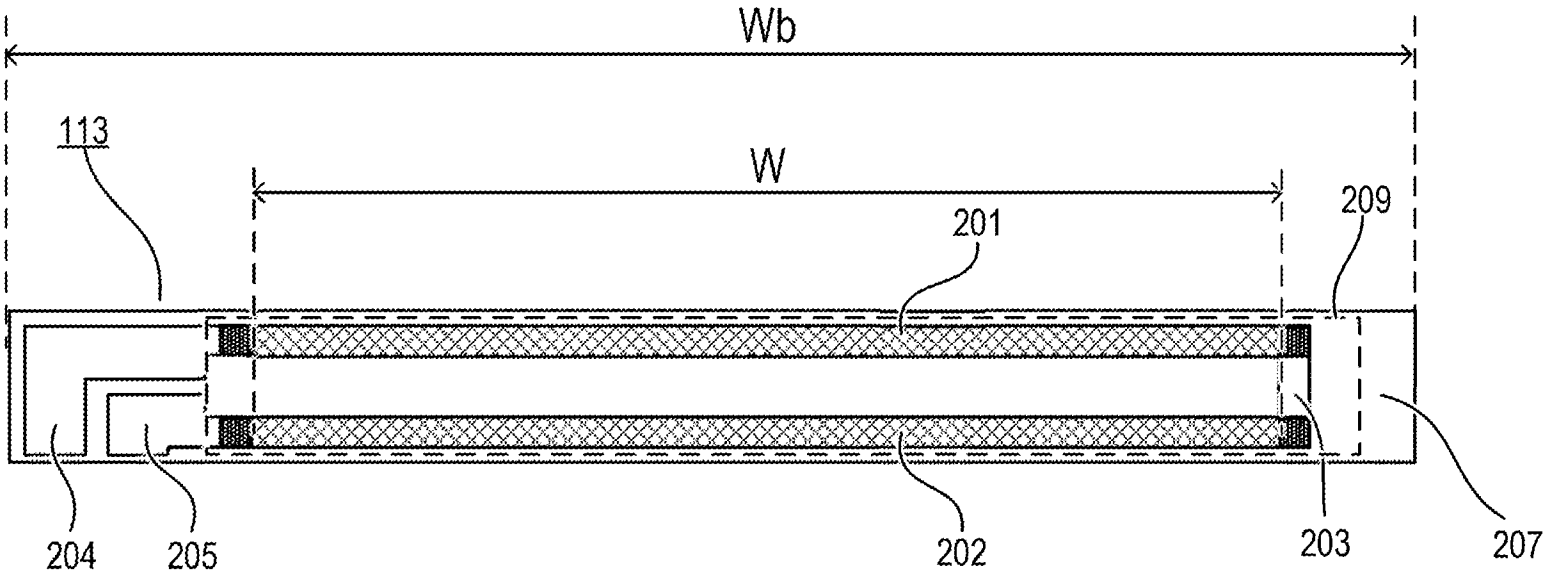
FIG. 4 is a diagram depicting a heater according to Embodiment 1.

FIG. 4 is a schematic diagram of the heater 113 viewed in the arrow A3 direction indicated in FIG. 3A. If the width W of the resistance heating elements 201 and 202 in the longitudinal direction is too narrow with respect to the maximum paper passing width to convey a recording material, fixability of the toner image on the edges of the recording material tends to drop due to heat release at the edges of the pressure roller 110. If the width W is too wide with respect to the maximum paper passing width to convey a recording material, on the other hand, the temperature in the non-paper passing region of the fixing member that contacts the heater 113 tends to rise. Considering these aspects, in Embodiment 1, the width W of the resistance heating elements 201 and 202 in the longitudinal direction is 218 mm, that is, longer than the letter-sized 216 mm (maximum width of the recording material that can be conveyed in the image forming device 50) by 1 mm on the left and right respectively.

The resistance heating elements 201 and 202 are disposed on the substrate 207 in series via a conductor 203, and are covered with a heating element protective layer 209. Conductive electrode units 204 and 205 are disposed on the edge of the resistance heating element 201 and the edge of the resistance heating element 202 respectively. The resistance heating elements 201 and 202 are heated by power supplied from the electrode units 204 and 205. In Embodiment 1, the width Wb of the substrate 207 in the longitudinal direction is 270 mm, which is sufficiently longer than the width W, so that the resistance heating elements 201 and 202, the conductor 203, the electrode units 204 and 205, and the heating element protective layer 209 are contained on the substrate 207.

Further, as illustrated in FIG. 2A and FIG. 3A, the temperature detection element 115, which detects the temperature of the ceramic substrate that rises in accordance with heating of the resistance heating elements 201 and 202, is disposed on the rear surface of the heater 113. The temperature of the heater 113 is adjusted by controlling the current that the electrode units 204 and 205 allow to flow into the resistance heating elements 201 and 202 in accordance with the signal of the temperature detection element 115.

(Heater Holder) The heater holder 130 (holding member) is preferably made of a material of which thermal capacity is low, so that not much heat is transferred from the heater holder 130 when the heater 113 starts up. In Embodiment 1, liquid crystal polymer (LCP), which is a heat resistant resin, is used for the heater holder 130.

Figure 5:
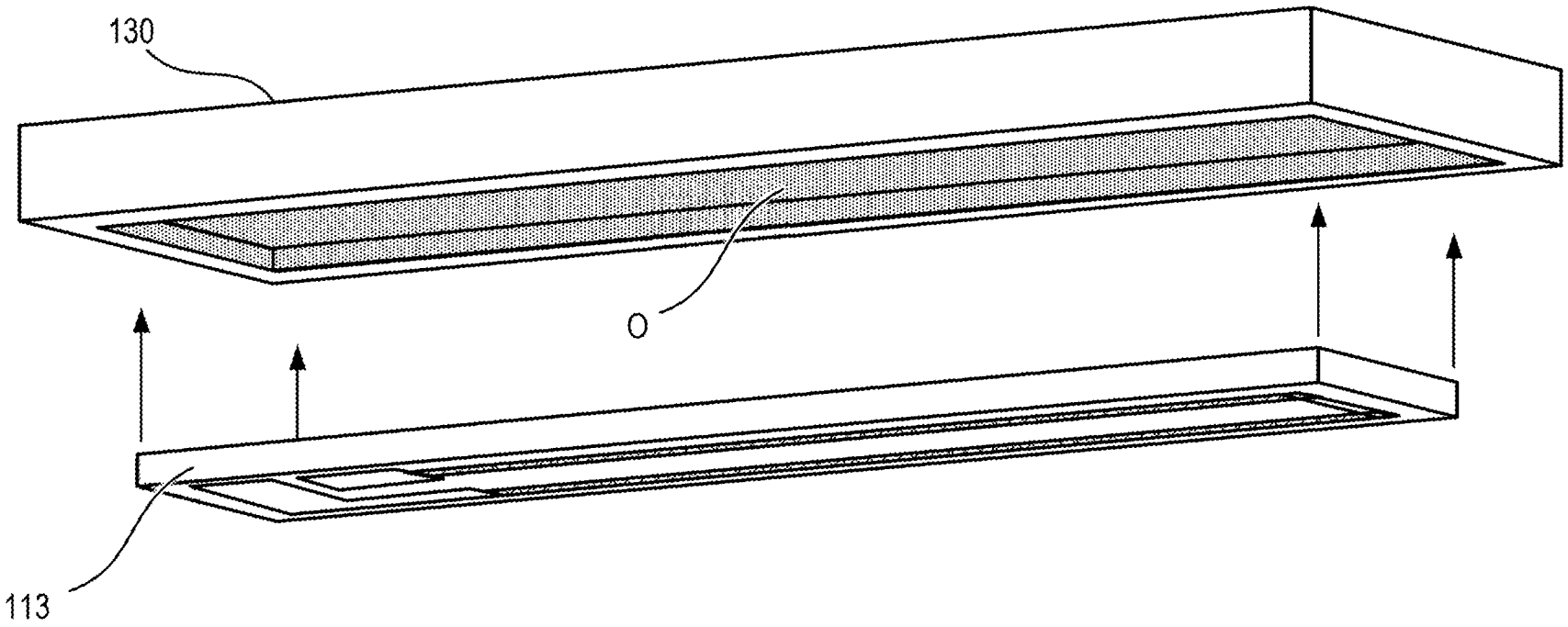
FIG. 5 is a diagram depicting connection between a heater holder and the heater according to Embodiment 1.

As illustrated in FIG. 5, a concave portion O, which is slightly larger than the heater 113, is formed in the heater holder 130. The heater 113 is held (connected) when the heater 113 is inserted into the concave portion O. The heater holder 130 also fixes (determines) the positions of the heater 113 in the longitudinal direction and the recording material P in the conveying direction. In Embodiment 1, out of the wall portions constituting the concave portion O of the heater holder 130, a wall portion corresponding to (facing to) the end face of the heater 113 in the longitudinal direction is formed in a concave shape (omitted in FIG. 5).

Figure 6A:
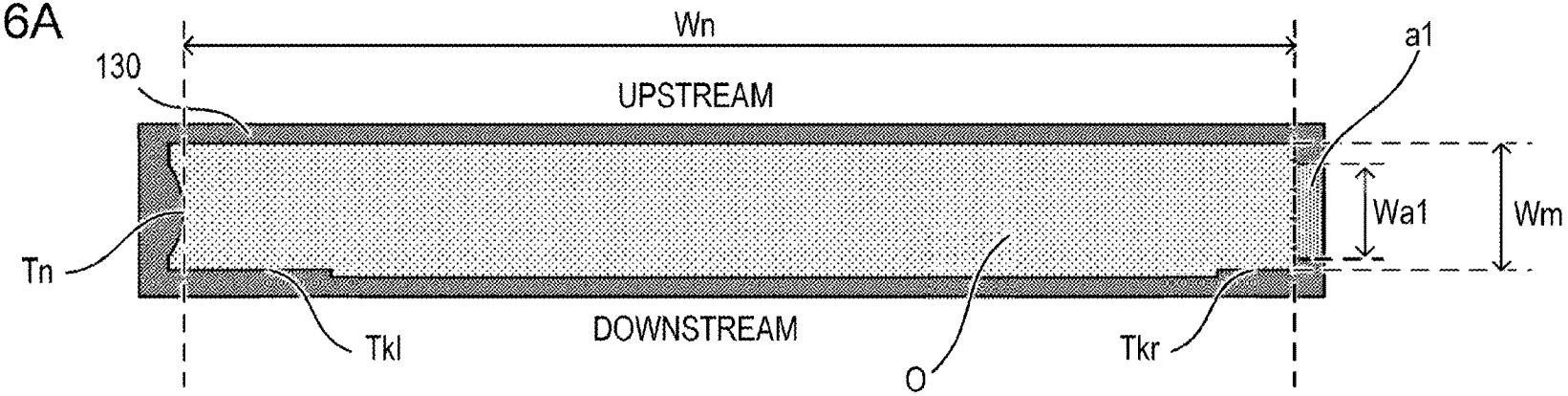
FIG. 6A to FIG. 6C are diagrams depicting a shape of the heater holder according to Embodiment 1.
Figure 6B:
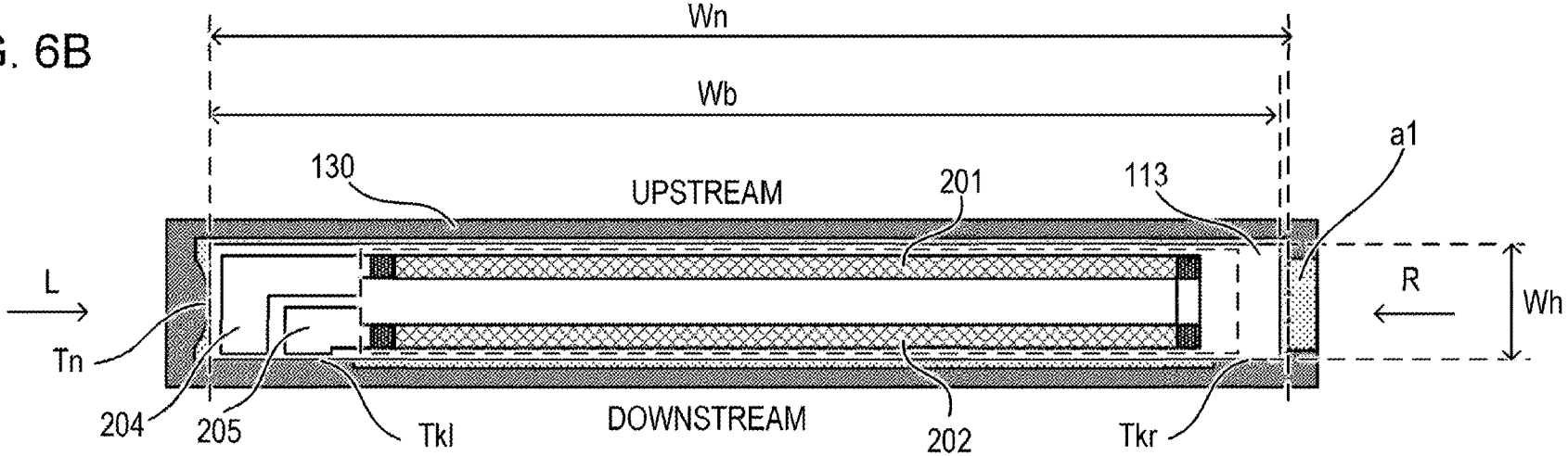
Figure 6C:
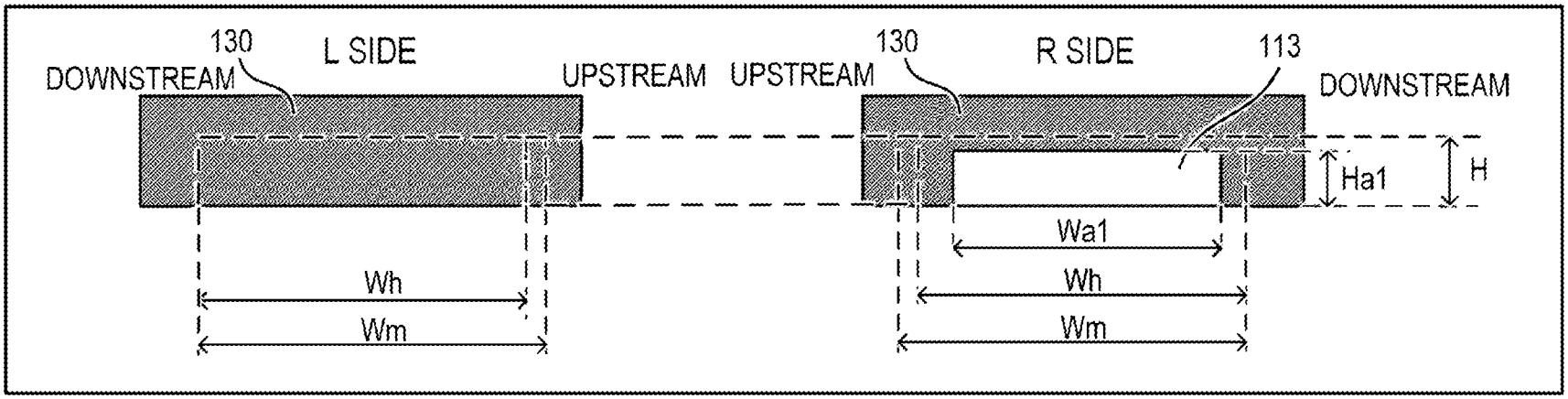

FIG. 6A and FIG. 6B are diagrams depicting a heater holder 130 viewed in the arrow A3 direction indicated in FIG. 3A. FIG. 6A is a diagram depicting only the heater holder 130. FIG. 6B is a diagram depicting a state where the heater 113 is held by the heater holder 130. FIG. 6C is a diagram depicting a side face of the heater holder 130 viewed in the arrow L direction and the arrow R directions indicated in FIG. 6B respectively.

The concave portion O of the heater holder 130 is larger than the heater 113, since the substrate 207 thermally expands when the heater 113 is heated. In Embodiment 1, the width Wn of the concave portion O of the heater holder 130 in the longitudinal direction is 271 mm, which is wider than the substrate width Wb (270 mm) by 1 mm. The width Wm of the concave portion O in the lateral direction (conveying direction of the recording material P) is 6.5 mm, which is wider than the substrate width Wh (6 mm) by 0.5 mm. The thickness of the concave portion O in the depth direction is 1 mm, which is the same as the substrate thickness H of the heater 113.

As illustrated in FIG. 6A and FIG. 6B, in the heater 113, an abutting position in the longitudinal direction is determined by an abutting portion Tn with the heater holder 130 (a portion where a part of the end face of the heater 113 contacts in the longitudinal direction), and an abutting position in the lateral direction is determined by abutting portions Tkl and Tkr on the left and right.

The heater holder 130 holds (covers) the heater 113 such that a part of one end face of the heater 113 in the longitudinal direction is exposed. Therefore one wall portion of the heater holder 130 is concave, whereby a space portion a1 (gap) is formed. By forming the wall portion to be concave so as to form the space portion a1, the wall portion having the space portion a1 can be formed simultaneously with other wall portions of the concave portion O by molding. In other words, a step of forming the space portion a1 (space portion) by shaving or the like, after forming the heater holder 130 in the state of not having the space portion a1, is not required. Hence the heater holder 130 having the space portion a1 can be formed easily, stably and at low cost.

As the side view in FIG. 6C indicates, a part of the heater 113 is exposed when the heater holder 130 is viewed in the arrow R direction. Here in the heater 113, the electrode units 204 and 205 are disposed on the arrow L side (see FIG. 6B) of the resistance heating elements 201 and 202. Therefore the region of the substrate 207 where the resistance heating elements 201 and 202 are not disposed (non-heating region) is longer on the L side (left side) than the R side (right side). In a commonly used heating device, the temperature in the paper passing regions on the left and right rises when a small-sized paper is passed, as illustrated in FIG. 15B, but in the case of the heater of Embodiment 1, where the non-heating regions on the left and right of the substrate are different, the temperature in the non-paper passing region on the shorter non-heating region becomes higher. Therefore in Embodiment 1, the temperature in the non-paper passing region on the R side (non-heating region is shorter) rises more easily compared with the L side. Hence in the heater holder 130, the space portion a1 is formed to cool down the R side of the heater 113.

As the space portion a1 becomes larger, the cooling effect on the temperature in the non-paper passing region increases, but if the space portion a1 is too large, the heater 113 fall off disengage during assembly, or the temperature in the edges of the heater 113 may drop when a large-sized paper is passed. Therefore it is preferable that the size of the space portion a1 is adjusted in according with the configuration. In Embodiment 1, the size of the space portion a1 is 4 mm for the width Wa1 in the lateral direction, and is 0.7 mm for the height Ha1 in the thickness direction of the heater 113. Further, in Embodiment 1, a space portion does not exist on the wall portion on the L side where the electrode units 204 and 205 of the heater 113 are disposed, because: the abutting portion Tn of the heater 113 in the longitudinal direction is on the L side; and the degree of temperature rising in the non-paper passing region when the small-sized paper is passed is relatively low.

As described above, in the heating device 100, the space portion a1 is formed on the wall portion of the heater holder 130, so that the heater 113 is exposed (is visible) from the edge of the heater 113 in the unit state in the longitudinal direction. Hence heat in the non-paper passing region of the heater 113 can be released from the space portion a1. Therefore the productivity does not drop in printing small-sized paper, where "non-paper passing portion temperature rising" tends to occur.

Figure 7:
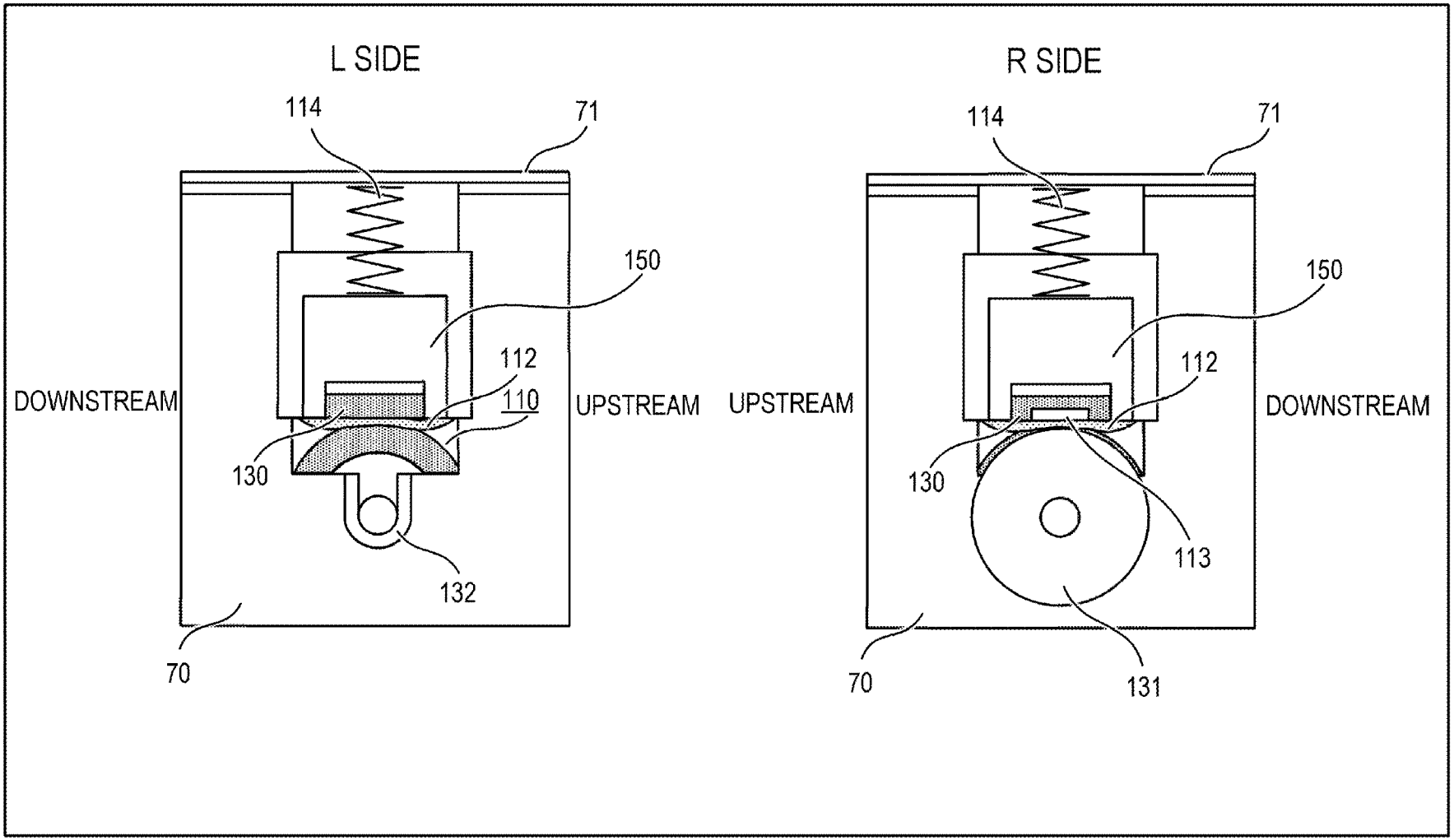
FIG. 7 is a diagram depicting side faces of the heating device according to Embodiment 1.

FIG. 7 is a diagram depicting the heating device 100 in FIG. 2B viewed from the left and right, that is, in the arrow L direction and the arrow R direction. On the R side of the heater holder 130 of the heating device 100, a space portion (gap) exists between the heater holder 130 and the fixing film 112, so that the end face of the heater 113 becomes visible. Here the heater 113 is exposed (is visible) in the unit state on the R side of the heater holder 130, since the components other than the heater holder 130, such as the fixing flange 150, does not cover the heater 113. On the other hand, the heater 113 is not exposed (is not visible) on the L side in FIG. 7. In other words, in the unit state where the fixing frame 70 integrally holds the heater 113 and the heater holder 130, a part of the end face of the heater 113 on the R side in the longitudinal direction is exposed in the longitudinal direction. Therefore in the fixing frame 70, at least a part of the heater 113 exposed from the heater holder 130 is also exposed outside the fixing frame 70.

Further, in the image forming device 50 of Embodiment 1, the cooling fan 60 is disposed to cool the non-paper passing region, and air is sent to both edges of the heating device 100 when small-sized paper is passed. If the heater 113 is exposed, as in the case of Embodiment 1, air directly hits the end face of the heated heater 113, hence the cooling effect is enhanced. Therefore a drop in productivity in printing small-sized paper, where the temperature tends to rise in the non-paper passing region, can be further controlled.

Figure 8:
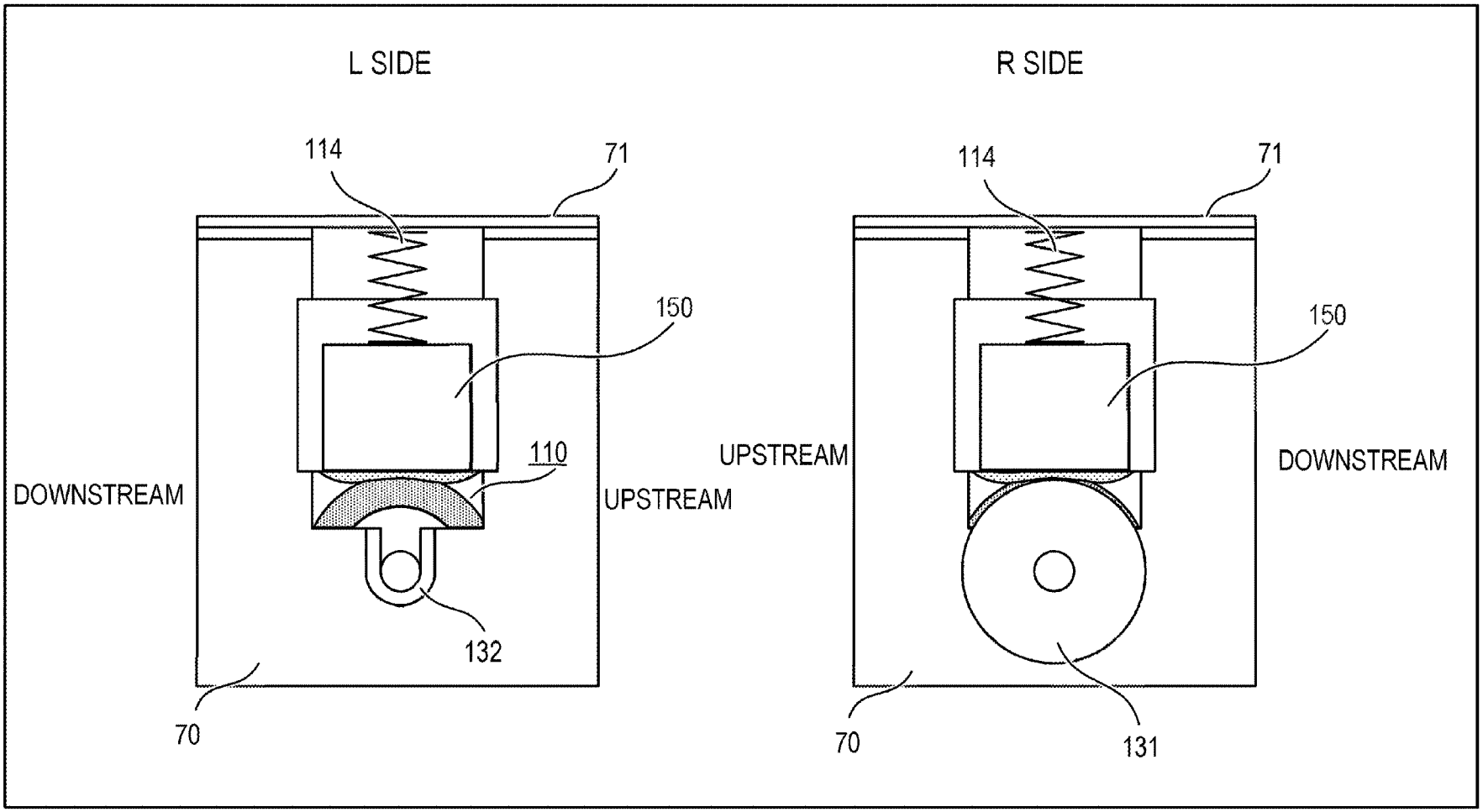
FIG. 8 is a diagram depicting side faces of a heating device according to a comparative example.

<Comparison with Comparative Example> FIG. 8 is a diagram depicting the heating device of a comparative example viewed from the left and right (L side and R side), and in this comparative example, both of the end faces of the heater 113 in the longitudinal direction are covered by the heater holder 130, and the heater 113 is invisible from the outside. In the heating device of the comparative example, the space portion is not formed at the end face (wall portion) of the heater holder 130 in the longitudinal direction, and the fixing flange 150 covers the heater holder, hence the heater is not exposed. The configuration of the heating device of the comparative example is the same as the heating device 100 according to Embodiment 1, except for the configuration of the heater holder and the fixing flanges.

The heating device of the comparative example illustrated in FIG. 8 and the heating device according to Embodiment 1 illustrated in FIG. 7 were compared by performing a test of passing small-sized paper. Here B5-sized paper (basis weight: 70 g/m$^2$) was continuously passed at a 35 prints per minute speed in two heating devices, and the surface temperature of the respective pressure roller 110 was measured using thermography. The upper limit of the heat resistant temperature of the silicon rubber used for the pressure roller 110 is normally 230° C., hence a number of prints of the B5-sized paper that can be continuously passed until the surface temperature in the non-paper passing region of the pressure roller 110 reached 230° C. was compared.

| | Left side | Right side |
|---|---|---|
| Configuration of comparative example | 40 prints | 35 prints |
| Configuration of Embodiment 1 | 40 prints | 42 prints |

In the configuration of the comparative example, the temperature rose quickly on the right side (R side) of the heater 113, and the surface temperature in the non-paper passing region of the pressure roller 110 reached 230° C. when 35 prints were passed. On the left side (L side) of the heater 113, the surface temperature in the non-paper passing region of the pressure roller 110 reached 230° C. when 40 prints were passed. In the configuration of Embodiment 1 illustrated in FIG. 7, on the other hand, the temperature rose quickly on the left side (L side) of the pressure roller 110 where the heater 113 is not exposed, and the surface temperature in the non-paper passing region of the pressure roller 110 reached 230° C. when 40 prints were passed, just like the comparative example. On the right side (R side) where the heater 113 is exposed, the surface temperature in the non-paper passing region of the pressure roller 110 reached 230° C. when 42 prints were passed.

By the space portion formed on the wall portion of the heater holder of the heating device in the unit state, as in the case of Embodiment 1, the end face of the heater in the longitudinal direction is exposed in the longitudinal direction, whereby the temperature rising speed in the non-paper passing region of the fixing member can be suppressed. Therefore the drop in productivity in printing small-sized paper, where "non-paper passing portion temperature rising" tends to occur, can be controlled.

Embodiment 2

In Embodiment 2, a heating device where the heater is exposed (is visible) from both edges of the heating device in the unit state will be described. Further, in Embodiment 2, an edge of the substrate of the heater on the resistance heating elements side and an edge thereof on the downstream side are exposed. Therefore the temperature in the non-paper passing region of the heater more easily decreases, and the drop in productivity in printing small-sized paper, where "non-paper passing portion temperature rising" tends to occur, can be controlled.

Unlike Embodiment 1, the image forming device having the heating device according to Embodiment 2 does not include the cooling fan. Hence if small-sized paper is passed in the same manner as Embodiment 1, the non-paper passing region of the fixing member cannot be cooled by the cooling fan. Therefore in Embodiment 2, the image forming device cools the non-paper passing region of the fixing member using air flow (natural convection) that rises toward the heating device.

The image forming device according to Embodiment 2 has the same configuration as Embodiment 1, except that the cooling fan 60 and the fan control unit 61 are not included. Hence detailed description on the configuration of the image forming device according to Embodiment 2 is omitted. Further, the configuration of the heating device is also the film heating type heating device, which is the same as Embodiment 1, except for the heater holder 130, hence a same member as Embodiment 1 is denoted with a same reference sign, and detailed description thereof is omitted.

Figure 9A:
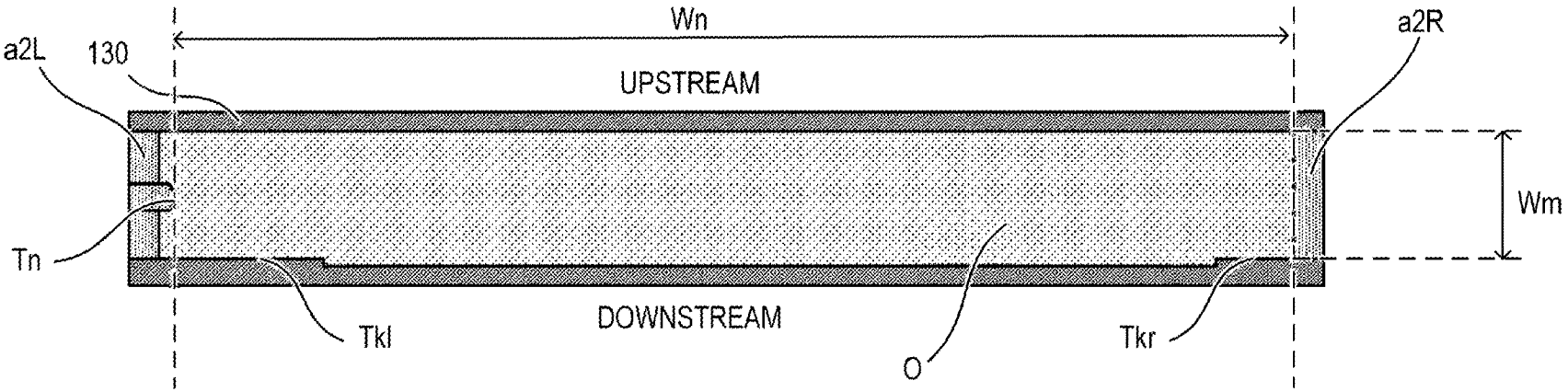
FIG. 9A to FIG. 9C are diagrams depicting a shape of a heater holder according to Embodiment 2.
Figure 9B:
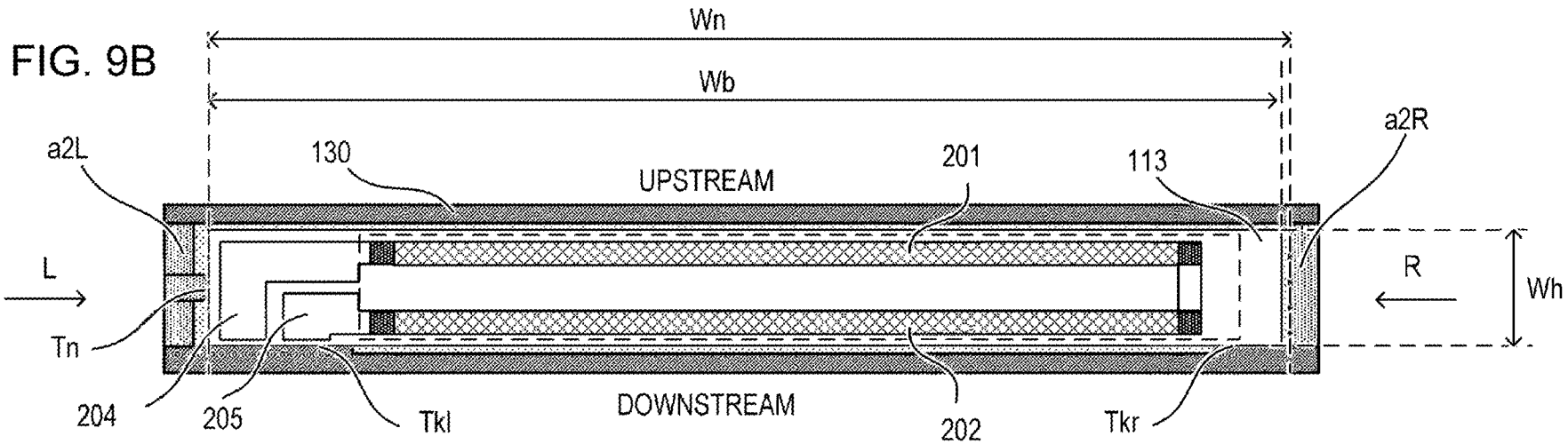
Figure 9C:
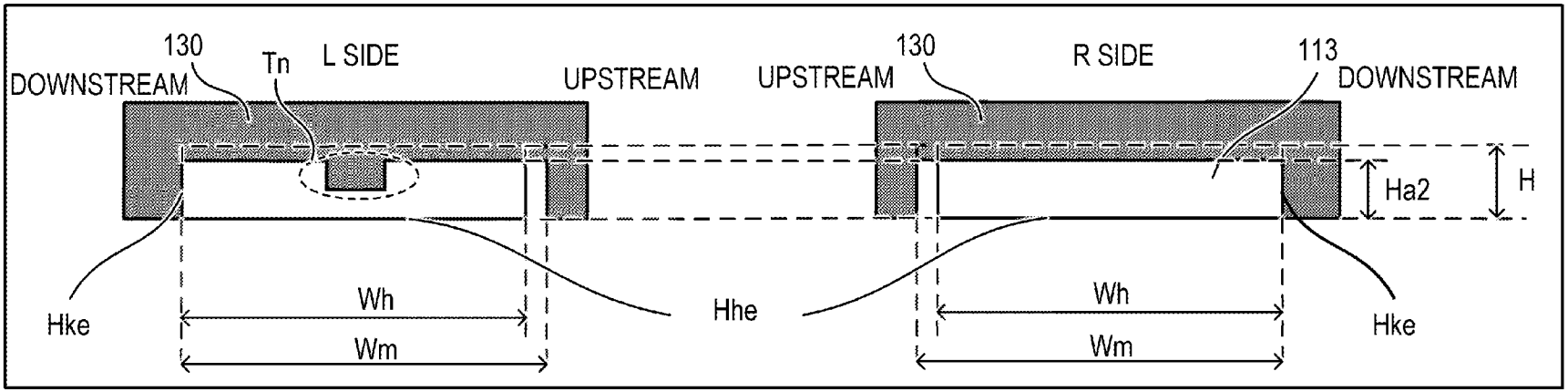

(Shape of Heater Holder) A shape of the heater holder 130 according to Embodiment 2 will be described. FIG. 9A and FIG. 9B are diagrams depicting the heater holder 130 viewed in the arrow A3 direction indicated in FIG. 3A. FIG. 9A is a diagram illustrating only the heater holder 130. FIG. 9B is a diagram illustrating the heater holder 130, which is in a state of holding the heater 113, and the heater 113. FIG. 9C is a diagram illustrating the heater holder 130 on the side faces viewed in the arrow L direction and the arrow R direction indicated in FIG. 9B respectively.

In the image forming device of Embodiment 2, a cooling fan to cool the non-paper passing region is not included. Therefore in the heater holder 130 of Embodiment 2, not only the wall portion on the arrow R side in FIG. 9B but also the wall portion on the arrow L side is formed in a concave shape. Since the heat is released from each space portion formed by the concave-shaped wall portions, both edges of the heater 113 are easily cooled down. Further, the size of the space formed by the concave-shaped wall portions is larger than that of Embodiment 1, so that cooling is performed by natural convection as well. As illustrated in FIG. 9C, when viewed in the arrow R direction and the arrow L direction, the side faces of the heater 113 are visible respectively from the space portions of the wall portions of the heater holder 130.

In the heater 113, the resistance heating elements 201 and 202 heat up by the power supplied from the electrode units 204 and 205, hence the temperature of the substrate 207 becomes higher on the side closer to the resistance heating elements in the thickness direction. Therefore in Embodiment 2, as shown in FIG. 9C, not only both edges of the heater 113 but also the substrate edge Hhe on the resistance heating element side (ridgeline formed by the surface of the heater on the side contacting the fixing film and the end face of the heater in the longitudinal direction) is completely exposed in the longitudinal direction. This generates a high cooling effect. Here the substrate edge Hhe need not be completely exposed in the longitudinal direction, and even a partial exposure thereof can generate the cooling effect.

The resistance heating elements 201 and 202 are evenly disposed on the upstream side and the downstream side in the conveying direction of the recording material P, with respect to the center of the heater 113 in the lateral direction. Therefore when the resistance heating elements 201 and 202 heat up while printing is stopped, the heating distribution becomes uniform in the upstream direction and the downstream direction.

However if the pressure roller 110 rotates in the R1 direction, as illustrated in the cross-sectional view in FIG. 3A, the fixing film 112 rotates in the R2 direction, hence in the temperature distribution in the heater 113 during rotation, the temperature on the downstream side in the conveying direction is higher than the center. Therefore in Embodiment 2, the substrate edge Hke on the downstream side (ridgeline formed by the end face of the heater in the longitudinal direction and the side face of the heater on the downstream side in the lateral direction), where temperature rises when both edges of the heater 113 are rotating, is exposed in the longitudinal direction, as illustrated in FIG. 9C.

The width of the space portion a2L in the lateral direction and the width of the space portion a2R in the lateral direction on both edges according to Embodiment 2 are 6.5 mm, which is the same as the width Wm of the concave portion O. Because of the space portion a2L and the space portion a2R having this width, the entire region of the substrate edge Hhe of the heater 113 is exposed, and the substrate edge Hke on the downstream side is also exposed on both edges. The thickness Ha2 of the space portion a2L and that of the space portion a2R are 0.7 mm, which is the same as Embodiment 1. An abutting portion Tn, to secure the heater, is formed on the L side edge of the heater holder 130 to be a convex shape.

Figure 10:
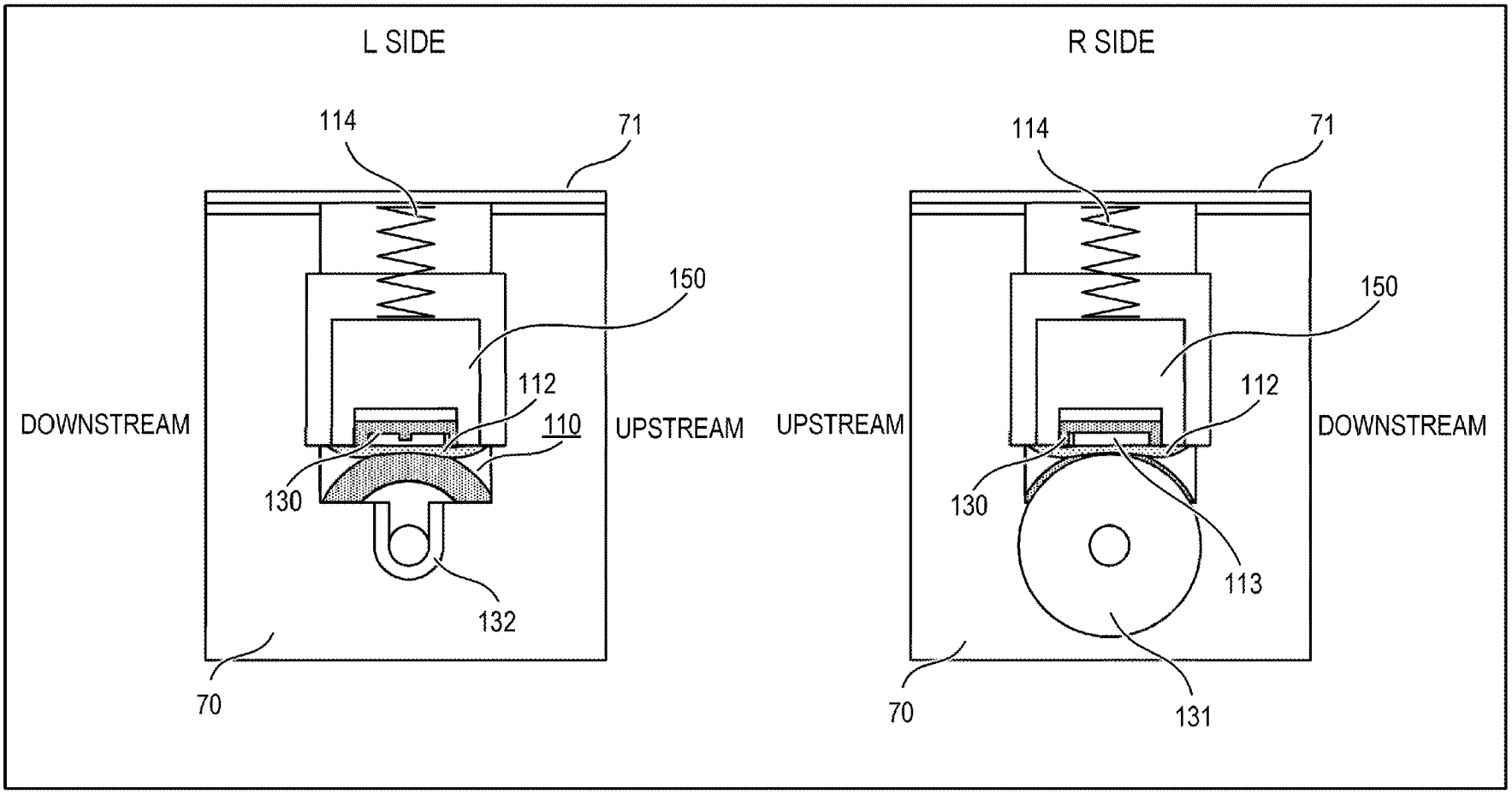
FIG. 10 is a diagram depicting side faces of a heating device according to Embodiment 2.

FIG. 10 is a diagram depicting the heating device according to Embodiment 1 in the unit state illustrated in FIG. 2B viewed from the left and right in the arrow L direction and the arrow R direction. In the heating device according to Embodiment 2, the space portion (gap) is formed between the heater holder 130 and the fixing film 112 not only on the R side but also on the L side, as mentioned above. Therefore both end faces of the heater 113 in the longitudinal direction are exposed (visible) to the outside. Further, as illustrated in FIG. 10, on both the L side and the R side, components other than the heater holder 130, such as the fixing flange 150, do not cover the heater 113 either. In other words, in the unit state, the fixing frame 70 and the heater holder 130 are configured such that a part of each end face of the heater 113 in the longitudinal direction is exposed in the longitudinal direction.

As described above, the cooling fan 60, to cool the heated non-paper passing region, is not disposed in the image forming device of Embodiment 2. However, the heater 113 in the unit state is exposed in a wide range, whereby the non-paper passing region of the fixing member is cooled down using air flow (natural convection). Therefore the drop in productivity in printing small-sized paper, where "non-paper passing portion temperature rising" tends to occur, can be controlled.

<Comparison with Comparative Example> The heating device according to the comparative example illustrated in FIG. 8 and the heating device according to Embodiment 2, where the heater is exposed when the heating device is in the unit state illustrated in FIG. 10, were compared by performing a test of passing small-sized paper. In the comparative example, it is assumed that the cooling fan is not disposed in the image forming device, just like Embodiment 2.

Just like the case of Embodiment 1, B5-sized paper (basis weight: 70 g/m$^2$) was continuously passed at a speed of 35 prints per minute in the respective heating devices, and a number of prints of B5-sized paper that can be continuously passed until the surface temperature in the non-paper passing region of the pressure roller 110 reached 230° C. was compared.

| | Left side | Right side |
|---|---|---|
| Configuration of comparative example | 20 prints | 15 prints |
| Configuration of Embodiment 2 | 30 prints | 28 prints |

In the comparative example, the temperature rose quickly on the right side (R side) of the heater 113 where the non-heating region is short, and the surface temperature in the non-paper passing region of the pressure roller reached 230° C. when 15 prints were passed. On the left side (L side) where the non-heating region is long, the surface temperature in the non-paper passing region reached 230° C. when 20 prints were passed. In the configuration of Embodiment 2 illustrated in FIG. 10, on the other hand, the temperature rose quickly on the right side (R side), and the surface temperature in the non-paper passing region reached 230° C. when 28 prints were passed; and on the left side (L side), the surface temperature in the non-paper passing region reached 230° C. when 30 prints were passed.

In the case of the image forming device that does not include a cooling fan, as in the case of Embodiment 2, the temperature rising speed in the non-paper passing region of the fixing member can be suppressed if the end faces of the heater in the longitudinal direction are exposed from the heater holder in the longitudinal direction. Therefore the drop in productivity in printing small-sized paper, where "non-paper passing portion temperature rising" tends to occur, can be controlled.

Embodiment 3

A heating device according to Embodiment 3 will be described. In Embodiment 3, in the heating device, both end faces of the heater in the longitudinal direction are completely visible. Therefore the temperature that rose in the non-paper passing region of the heater more easily decreases, and the drop in productivity in the printing small-sized paper can be controlled.

The imaging forming device having the heating device according to Embodiment 3 does not include a cooling fan, just like Embodiment 2. The configuration of this image forming device is the same as Embodiment 1 and Embodiment 2, hence description thereof is omitted. The configuration of the heating device is the film heating type heating device, which is the same as Embodiment 1, except for the heater holder 130, hence a same member as Embodiment 1 is denoted with a same reference sign, and detailed description thereof is omitted.

Figure 11A:
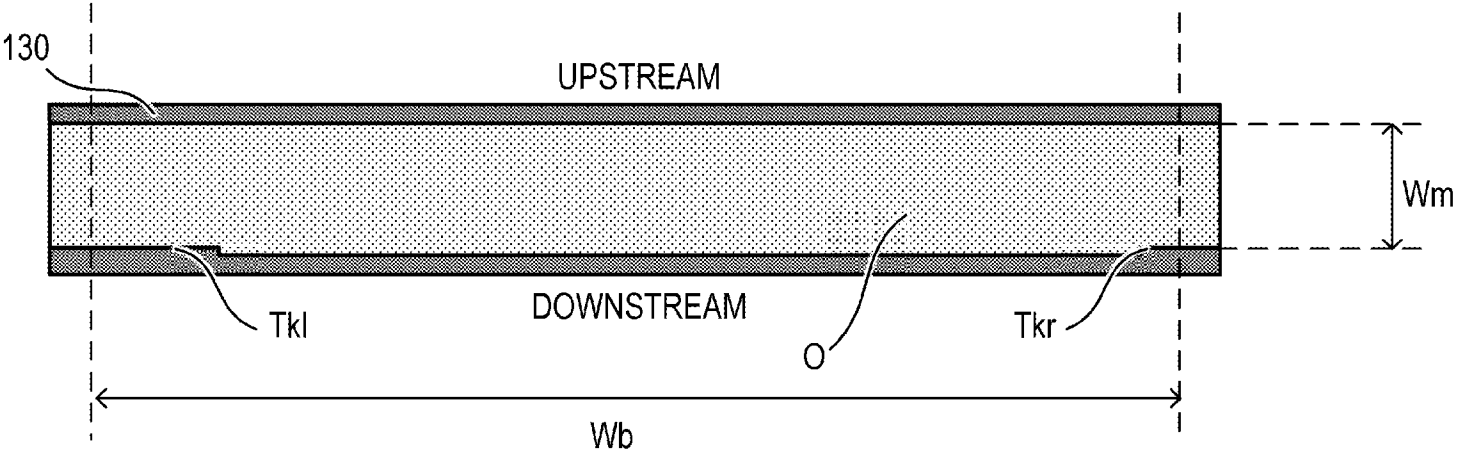
FIG. 11A to FIG. 11C are diagrams depicting a shape of a heater holder according to Embodiment 3.
Figure 11B:
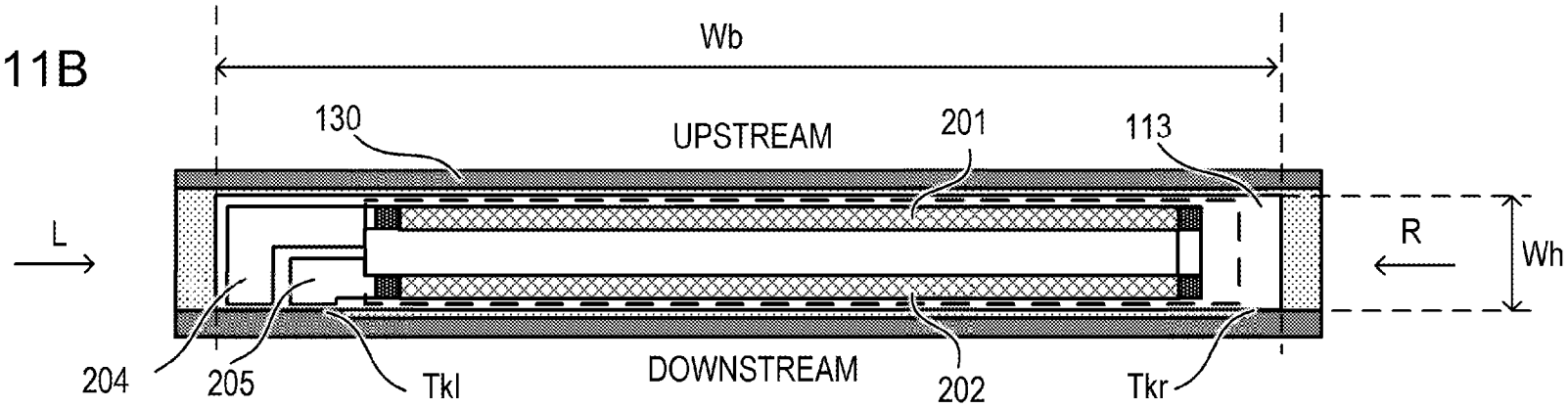
Figure 11C:
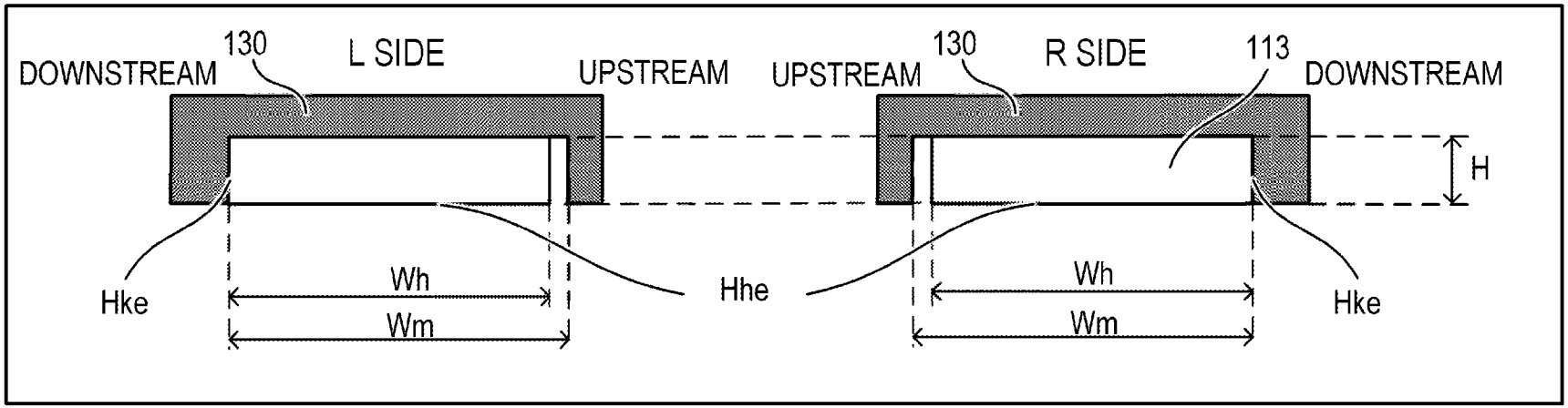

(Shape of Heater Holder) A shape of the heater holder 130 according to Embodiment 3 will be described. FIG. 11A and FIG. 11B are diagrams depicting the heater holder 130 according to Embodiment 3, viewed in the arrow A3 direction indicated in FIG. 3A. FIG. 11A is a diagram illustrating only the heater holder 130, and FIG. 11B is a diagram illustrating the heater holder 130 holding the heater 113. FIG. 11C is a diagram depicting the heater holder 130 on the side faces viewed in the arrow L direction and the arrow R direction indicated in FIG. 11B respectively.

In the heater holder 130 of Embodiment 3, two wall portions, corresponding to (facing) both end faces of the heater 113 in the longitudinal direction, are formed in a concave shape, whereby both of these end faces are exposed. Further, the abutting portions of the heater 113 in the longitudinal direction do not exist, and both of the end faces of the heater 113 are completely exposed from the left and right. In Embodiment 3, deviation or falling off of the heater is prevented by bonding the heater 113 to the concave portion O of the heater holder 130. Since the end faces of the heater 113 in the longitudinal direction are completely exposed, the effect of cooling the heated non-paper passing region is higher than Embodiment 2.

Figure 12:
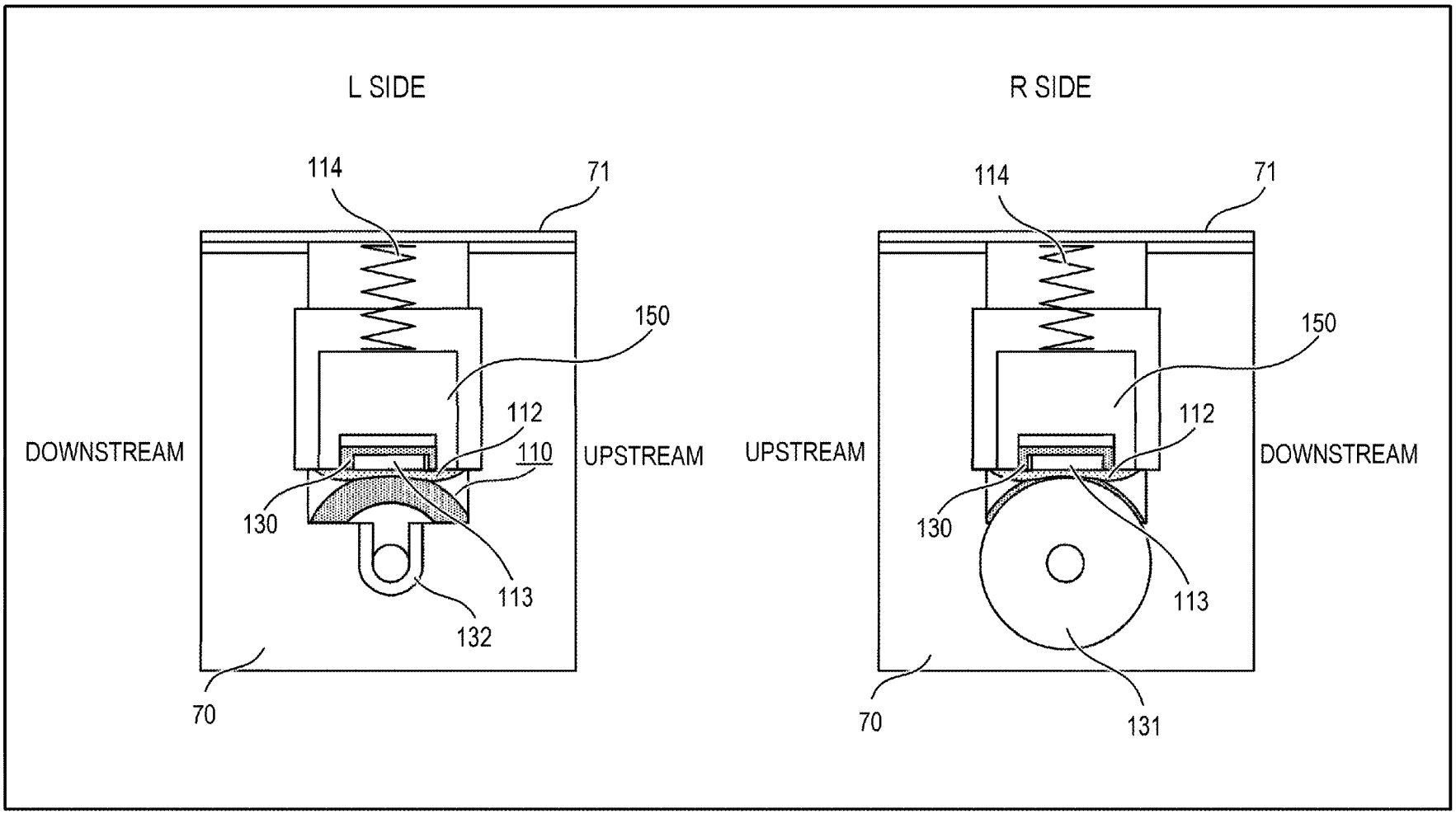
FIG. 12 is a diagram depicting side faces of a heating device according to Embodiment 3.

(Heating Device in Unit State) FIG. 12 is a diagram depicting the heating device illustrated in FIG. 2B viewed in the arrow L direction and the arrow R direction. In the heating device according to Embodiment 3, a space (gap) is formed between the heater holder 130 and the fixing film 112, whereby the end faces of the heater 113 are completely exposed from the left and right of the heater holder 130. As illustrated in FIG. 12, the end faces of the heater 113 in the unit state are exposed on both the L side and the R side, without any components other than the heater holder 130 such as the fixing flange 150, covering the heater 113. Therefore in the case of the image forming device according to Embodiment 3, where the end faces of the heater 113 in the unit state are completely exposed, the non-paper passing region of the fixing member can be more easily cooled down by air flow caused by natural convection.

<Comparison with Comparative Example> In Embodiment 3 as well, the heating device according to Embodiment 3 illustrated in FIG. 12 and the heating device according to the comparative example illustrated in FIG. 8 were compared by performing a test of passing small-sized paper. Just like the case of Embodiment 2, B5-sized paper (basis weight: 70 g/m$^2$) was continuously passed at a speed of 35 prints per minute in the respective heating devices, and a number of prints of the B5-sized paper that can be continuously passed until the surface temperature in the non-paper passing region of the pressure roller 110 reached 230° C. was compared.

| | Left side | Right side |
|---|---|---|
| Configuration of comparative example | 20 prints | 15 prints |
| Configuration of Embodiment 2 | 30 prints | 28 prints |
| Configuration of Embodiment 3 | 32 prints | 30 prints |

In the heating device according to Embodiment 3, the temperature rising speed in the non-paper passing region of the pressure roller is slower than the configuration of Embodiment 2, and until the surface temperature of the pressure roller 110 in the non-paper passing region reaches 230° C., 30 prints were passed on the right side (R side), and 32 prints were passed on the left side (L side).

As described above, the temperature rising speed in the non-paper passing region of the heater can be suppressed if the end faces of the heater 113 are completely exposed. Therefore the drop in productivity in printing small-sized paper, where "non-paper passing portion temperature rising" tends to occur, can be controlled.

Other Embodiments

In Embodiments 1 to 3, the end face of the heater 113 in the longitudinal direction is exposed by forming the end face (wall portion) of the heater holder 130 in a concave shape in the longitudinal, but the present invention is not limited to this. Specifically, the end face of the heater 113 in the longitudinal direction may be exposed by forming a hole that is opened through a part of the end face (wall portion) of the heater holder 130 in the longitudinal direction. Further, in Embodiments 1 to 3, the shape of the space portion in the heater holder 130 is a rectangle since it is easy to form, but may be another polygon or semicircle.

In Embodiments 1 to 3, an example of using an alumina substrate made of ceramic as the substrate 207 was described, but the present invention is not limited to this. In the film heating type heating device, a high thermal conductive ceramic, such as aluminum nitride (AlN), or a metal substrate, such as SUS, may be used so as to further shorten the rise time.

In the case of using a high thermal conductive material for the material of the substrate in this way, the thermal conductivity of the substrate may become higher than a glass material used for the heating element protective layer of the heater. In such a case, the resistance heating elements may be disposed on the rear surface side (heater holder side) using the high thermal conductivity substrate for the surface that contacts (slides) with the fixing film. Then the functional effect similar to the above mentioned embodiments can be implemented by forming a space portion on the wall portion of the heater holder and exposing the end face of the heater in the longitudinal direction.

In the above description, the image forming device is a device that forms a monochrome image, but may be a color image forming device which prints an image superimposing four colors: yellow, magenta, cyan and black. Further, the film heating type heating device was described, but the present invention is not limited to this. For example, the color heating device includes: a device which uses solid rubber for the elastic layer of the pressure roller; and a film heating type device where an elastic layer is disposed on the fixing film to improve the image quality. For such a color heating device as well, the functional effects similar to the above mentioned embodiments can be implemented by forming a space portion on the wall portion of the heater holder, and exposing the end face of the heater in the longitudinal direction.

Figure 13:
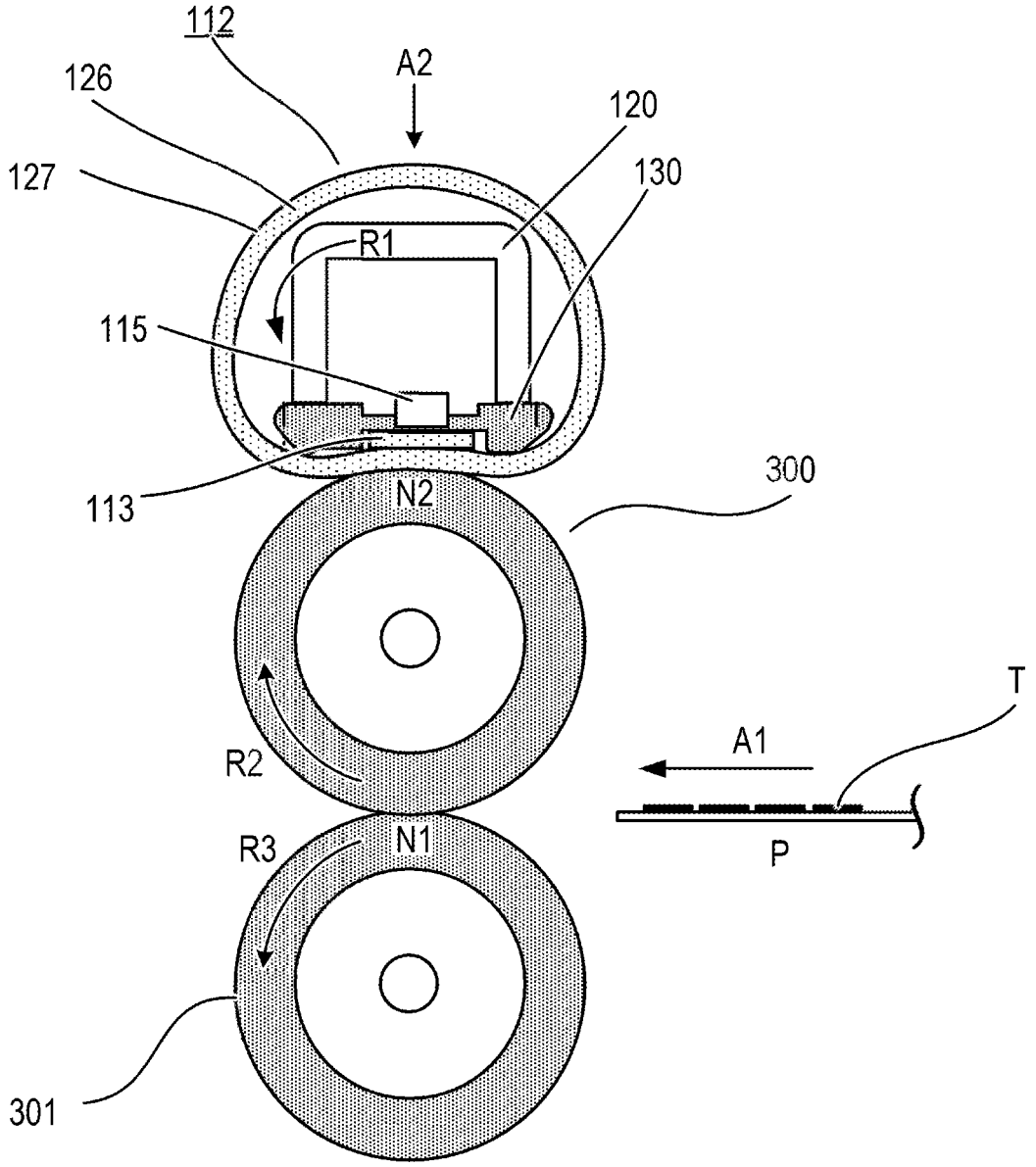
FIG. 13 is a diagram depicting a heating device according to another embodiment.

Instead of the above mentioned film heating type heating device, an external heating type heating device illustrated in FIG. 13 may be used. In the heating device illustrated in FIG. 13, the heater 113 is included in the fixing film 112, and a fixing roller 300 press-contacts with the outer surface (outer peripheral surface) of the fixing film 112 to form a heating nip N2. Thereby the heater 113 heats the surface of the fixing roller 300 via the fixing film 112. Then in the fixing nip N1, which is formed by a pressure roller 301 press-contacting the fixing roller 300, the toner image T (image on the recording material) is fixed to the recording material P.

In such an external heating type heating device as well, if the space portion is formed on the wall portion of the heater holder and the end face of the heater in the longitudinal direction is exposed in the longitudinal direction, the temperature rising speed in the non-paper passing region of the heater, when small-sized paper is passed, can be suppressed. Therefore the temperature rising in the non-paper passing region of the small-sized paper can be suppressed without complicating the device configuration, and the drop in productivity in printing small-sized paper can be controlled.

Figure 14A:
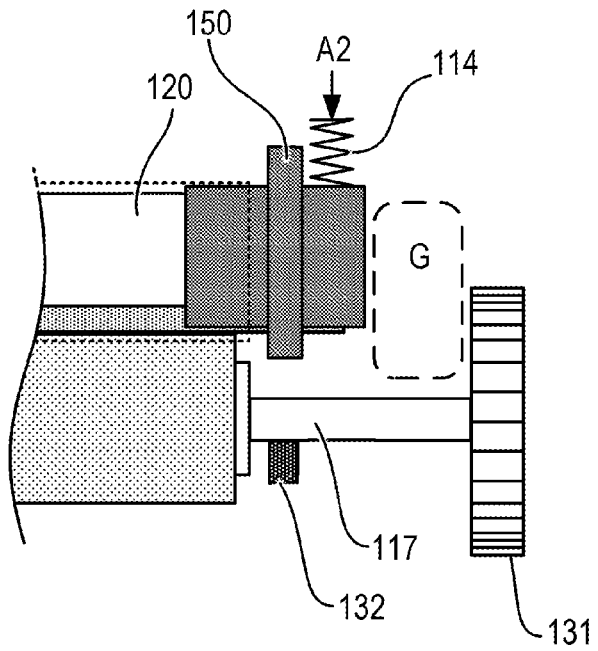
FIG. 14A and FIG. 14B are diagrams depicting a heating device according to another embodiment.
Figure 14B:
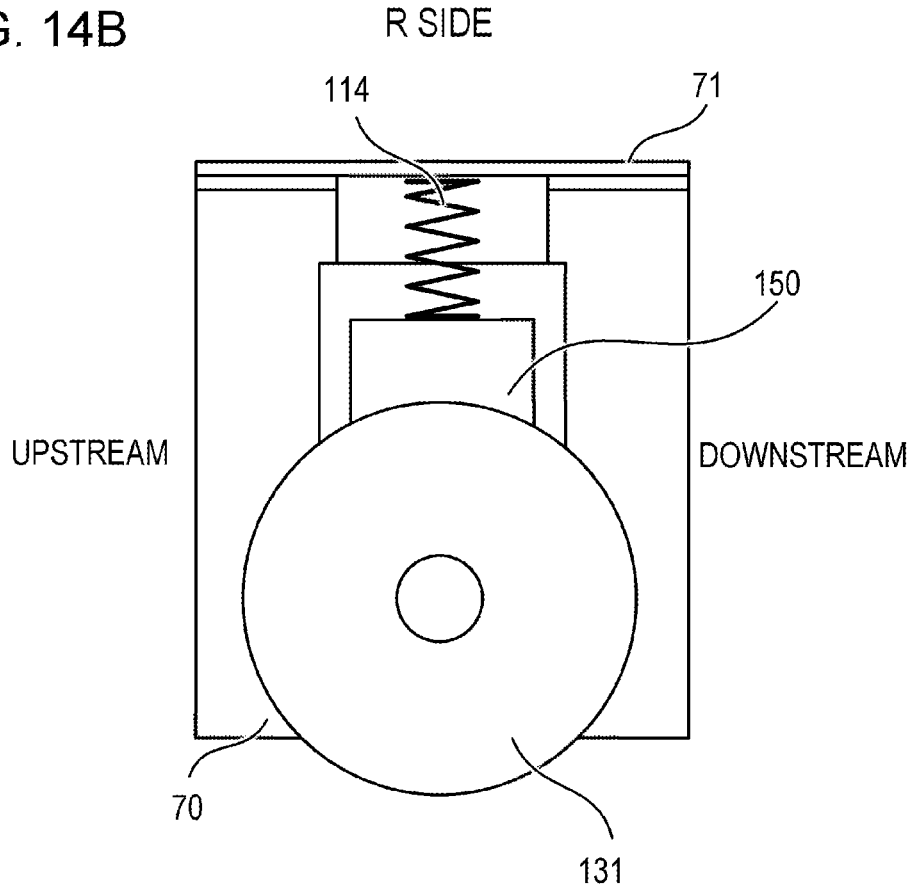

In the heating device described above in each embodiment, the diameter of the driving gear 131 is small on the R side, so that the side face of the heater 113 is exposed without the driving gear 131 hiding the heater 113, as illustrated in FIG. 7. However in some cases, the driving gear 131 may hide the heater 113 when the heating device unit is viewed from the side face, as illustrated in FIG. 14B, because the diameter of the driving gear 131 is large, as illustrated in FIG. 14A. Even in such a case, if the wall portion of the heater holder 130 is formed in a concave shape, as illustrated in FIG. 14A, the heater 113 is then exposed from the heater holder 130, and a gap G, into which air can flow, can be formed between the heater 113 and the driving gear 131. Hence when the end face of the heater 113 is exposed to the gap G, air is sent to the end face of the heater 113 via the space portion of the heater holder 130.

In the heating device, the space portion is formed on the wall portion of the heater holder, thereby the end face of the heater in the longitudinal direction is exposed in the longitudinal direction, and "non-paper passing portion temperature rising" in the heating device can be suppressed. Therefore the drop in productivity in printing small-sized paper can be controlled without complicating device configuration.

According to the present invention, the drop in productivity in printing small-sized paper can be controlled.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-132940, filed on Aug. 5, 2020, which is hereby incorporated by reference herein in its entirety.

What is claimed is:

1. A heating device comprising:

a heating member that includes a heating element;

a holding member that holds the heating member;

a first rotating member having an internal space in which the heating member and the holding member are disposed;

a second rotating member that contacts an outer peripheral surface of the first rotating member; and a frame that includes an internal space extending in a longitudinal direction and that integrally supports the heating member, the holding member, the first rotating member, and the second rotating member by each of the heating member, the holding member, the first rotating member, and the second rotating member being arranged along the longitudinal direction, disposed within the internal space of the frame, and fixed in the internal space of the frame by a fixing cover, wherein the second rotating member forms a nip portion between the first rotating member and the second rotating member, the holding member holds the heating member such that at least a part of at least one end face of the heating member in a longitudinal direction thereof is exposed in the longitudinal direction, and when viewed in the longitudinal direction from a side of the end face of the heating member, the frame is configured such that at least the part of the heating member, which is exposed from the holding member, is also exposed out of the frame.

2. The heating device according to claim 1, wherein the holding member has a recessed portion in which the heating member is inserted, and a wall portion facing at least one end face of the heating member, out of wall portions forming the recessed portion, is configured such that at least the part of one end face of the heating member in the longitudinal direction is exposed in the longitudinal direction.

3. The heating device according to claim 1, wherein the holding member holds the heating member such that at least one end face of the heating member in the longitudinal direction is completely exposed in the longitudinal direction.

4. The heating device according to claim 1, wherein the heating member includes an electrode that supplies power to the heating element, and when viewed in the longitudinal direction from a side of an end face of the heating member where the electrode is provided, the holding member holds the heating member such that an end face in the longitudinal direction on a side, where the electrode is disposed for the heating element, is not exposed.

5. The heating device according to claim 1, wherein the holding member holds the heating member such that at least a part of each end face of the heating member in the longitudinal direction is exposed in the longitudinal direction.

6. The heating device according to claim 1, wherein at least one end face of the heating member in the longitudinal direction contacts the holding member.

7. The heating device according to claim 1, wherein the holding member holds the heating member such that both end faces of the heating member in the longitudinal direction are completely exposed in the longitudinal direction.

8. The heating device according to claim 1, wherein the holding member holds the heating member such that a part of a ridgeline, which is formed by a surface of the heating member on a side contacting the first rotating member and an end face of the heating member in the longitudinal direction, is exposed in the longitudinal direction.

9. The heating device according to claim 1, wherein the holding member holds the heating member such that a part of a ridgeline, which is formed by an end face of the heating member in the longitudinal direction and a side face of the heating member in a lateral direction thereof on a downstream side in a conveying direction of a recording material, is exposed in the longitudinal direction.

10. The heating device according to claim 1, wherein the first rotating member is a tubular film, the second rotating member is a roller that contacts the outer peripheral surface of the film, the film is held between the heating member and the roller, and an image on a recording material is heated via the film in the nip portion formed between the film and the roller.

11. An image forming device comprising:

a forming device configured to form an image on a recording material; and the heating device according to claim 1, configured to heat the image formed on the recording material, with the recording material passing through the nip portion.

12. The image forming device according to claim 11, further comprising a cooling device that cools the heating device by sending air to both edges of the heating device in the longitudinal direction.

13. A heating device comprising:

a heating member that includes a heating element;

a holding member that holds the heating member;

a first support member that supports the holding member;

a first rotating member having an internal space in which the heating member and the holding member are disposed;

a second support member that supports an inner peripheral surface of the first rotating member;

a second rotating member that contacts an outer peripheral surface of the first rotating member;

and a frame that integrally supports the heating member, the holding member, the first support member, the first rotating member, the second support member, and the second rotating member, wherein the second rotating member forms a nip portion between the first rotating member and the second rotating member, the holding member holds the heating member such that at least a part of at least one end face of the heating member in a longitudinal direction thereof is exposed in the longitudinal direction, and when viewed in the longitudinal direction from a side of the end face of the heating member, the second support member is configured to overlap with the first support member, and when viewed in the longitudinal direction from a side of the end face of the heating member, the frame is configured such that at least the part of the heating member, which is exposed from the holding member, is also exposed out of the frame.

14. The heating device according to claim 13, wherein the holding member has a recessed portion in which the heating member is inserted, and a wall portion facing at least one end face of the heating member, out of wall portions forming the recessed portion, is configured such that at least the part of one end face of the heating member in the longitudinal direction is exposed in the longitudinal direction.

15. The heating device according to claim 13, wherein the holding member holds the heating member such that at least one end face of the heating member in the longitudinal direction is completely exposed in the longitudinal direction.

16. The heating device according to claim 13, wherein the heating member includes an electrode that supplies power to the heating element, and when viewed in the longitudinal direction from a side of an end face of the heating member where the electrode is provided, the holding member holds the heating member such that an end face in the longitudinal direction on a side, where the electrode is disposed for the heating element, is not exposed.

17. The heating device according to claim 13, wherein the holding member holds the heating member such that at least a part of each end face of the heating member in the longitudinal direction is exposed in the longitudinal direction.

18. The heating device according to claim 13, wherein at least one end face of the heating member in the longitudinal direction contacts the holding member.

19. The heating device according to claim 13, wherein the holding member holds the heating member such that both end faces of the heating member in the longitudinal direction are completely exposed in the longitudinal direction.

20. The heating device according to claim 13, wherein the first rotating member is a tubular film, the second rotating member is a roller that contacts the outer peripheral surface of the film, the film is held between the heating member and the roller, and an image on a recording material is heated via the film in the nip portion formed between the film and the roller.

21. An image forming device comprising:

a forming device configured to form an image on a recording material; and the heating device according to claim 13, configured to heat the image formed on the recording material, with the recording material passing through the nip portion.

22. The image forming device according to claim 21, further comprising a cooling device that cools the heating device by sending air to both edges of the heating device in the longitudinal direction.

* * * * *